US010466626B2

(12) United States Patent
Yang et al.

(10) Patent No.: US 10,466,626 B2
(45) Date of Patent: Nov. 5, 2019

(54) SHEET SUPPLYING APPARATUS, SHEET PROCESSING APPARATUS EMPLOYING THE SAME, AND IMAGE FORMING APPARATUS

(71) Applicant: HP PRINTING KOREA CO., LTD, Suwon-si, Gyeonggi-Do (KR)

(72) Inventors: Seung-beom Yang, Suwon-si (KR); Sung-dae Kim, Suwon-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

(21) Appl. No.: 15/641,711

(22) Filed: Jul. 5, 2017

(65) Prior Publication Data

US 2018/0011430 A1 Jan. 11, 2018

(30) Foreign Application Priority Data

Jul. 5, 2016 (KR) ..... 10-2016-0085072

(51) Int. Cl.

| | |
|---|---|
| ***B65H 3/66*** | (2006.01) |
| ***B65H 9/06*** | (2006.01) |
| ***G03G 15/16*** | (2006.01) |
| ***G03G 15/20*** | (2006.01) |
| ***B65H 3/06*** | (2006.01) |

(Continued)

(52) U.S. Cl.

CPC ..... *G03G 15/1615* (2013.01); *B65H 3/0669* (2013.01); *B65H 3/0684* (2013.01); *B65H 3/5261* (2013.01); *B65H 3/565* (2013.01); *B65H 3/66* (2013.01); *B65H 9/06* (2013.01); *G03G 15/2028* (2013.01); *G03G 15/6511* (2013.01); *B65H 2403/421* (2013.01); *B65H 2403/422* (2013.01); *B65H 2403/512* (2013.01); *B65H 2403/942* (2013.01)

(58) Field of Classification Search

CPC ..... B65H 2403/421; B65H 2403/422

See application file for complete search history.

(56) References Cited

U.S. PATENT DOCUMENTS 6,234,616 B1 * 5/2001 Komuro ..... B41J 2/17596 347/85

8,042,800 B2 10/2011 Hsu (Continued)

FOREIGN PATENT DOCUMENTS

KR 10-2005-0049799 5/2005

*Primary Examiner* — Jill E Culler

*Assistant Examiner* — Ruben C Parco, Jr.

(74) *Attorney, Agent, or Firm* — Staas & Halsey LLP

(57) ABSTRACT

A sheet supplying apparatus includes an alignment member pivotable to an alignment location for blocking and aligning fore-ends of media contained on a loading table, and a transport-allowing location for allowing a medium picked up by a pickup member to be transported, a cam gear including a gear portion partially including a tooth-omitted portion, and a cam portion for switching the alignment member between the alignment location and the transport-allowing location at first and second rotating locations, a swing arm pivotable about a same axis as a rotation axis of a main gear, and first and second swing gears supported by the swing arm to interlock with the main gear, selectively interlocking with the gear portion according to a rotating direction of the main gear, and rotating the cam gear to the first and second rotating locations.

11 Claims, 20 Drawing Sheets

(51) Int. Cl.

| | |
|---|---|
| ***B65H 3/52*** | (2006.01) |
| ***B65H 3/56*** | (2006.01) |
| ***G03G 15/00*** | (2006.01) |

(56) References Cited

U.S. PATENT DOCUMENTS

| | | | | |
|---|---|---|---|---|
| 2006/0038339 | A1* | 2/2006 | Shimamura | B65H 3/56 271/121 |
| 2011/0316219 | A1* | 12/2011 | Tu | B65H 3/0684 271/10.13 |
| 2017/0066608 | A1* | 3/2017 | Kondo | B65H 3/0669 |

* cited by examiner

SHEET SUPPLYING APPARATUS, SHEET PROCESSING APPARATUS EMPLOYING THE SAME, AND IMAGE FORMING APPARATUS

CROSS-REFERENCE TO RELATED APPLICATIONS

This application claims the priority benefit of Korean Patent Application No. 10-2016-0085072, filed on Jul. 5, 2016, in the Korean Intellectual Property Office, the disclosure of which is incorporated herein in its entirety by reference.

BACKGROUND

1. Field

One or more embodiments relate to a sheet supplying apparatus that feeds one sheet at a time from a loading table, a sheet processing apparatus employing the sheet supplying apparatus, and an image forming apparatus.

2. Description of the Related Art

Apparatuses using a sheet-type medium, for example, a cut sheet (hereinafter, referred to as paper), such as, printers, scanners, and ticket machines, employ a sheet supplying apparatus that feeds one sheet at a time from a loading table on which a plurality of sheets are placed.

A pickup roller that picks up a sheet of paper from a loading table contacts paper when feeding is performed, but is apart from the paper when feeding is not performed. The pickup roller is provided on a holder supported to be pivotable about a shaft. The pickup roller is connected to the shaft and is rotatable by the shaft. A spring clutch, a torque limiter, and the like are mounted on the shaft to rotate the holder due to a load when the shaft rotates, thereby making the pickup roller be in contact with/apart from paper. However, the spring clutch and the torque limiter may increase a driving load and generate noise when being operated. A difference between pressing forces with which the pickup roller presses paper may increase a risk of multi-feeding.

A stopper that switches between a location for aligning fore-ends of papers contained on the loading table and a location allowing paper to be fed and transported may be employed. In this case, driving equipment, such as a solenoid, is employed to drive the stopper, which causes a cost increase.

SUMMARY

One or more embodiments include a sheet supplying apparatus capable of switching locations of a pickup member and an alignment member, and a sheet processing apparatus employing the sheet supplying apparatus.

One or more embodiments include an image forming apparatus capable of pressing/releasing a pressing roller to/from a fixing roller.

One or more embodiments include an image forming apparatus capable of pressing/releasing an intermediate transfer roller to/from a photoconductor.

Additional aspects will be set forth in part in the description which follows and, in part, will be apparent from the description, or may be learned by practice of the disclosed embodiments.

According to one or more embodiments, a sheet supplying apparatus may include a loading table on which media of a sheet type are contained, a pickup member configured to pick up the media, an alignment member pivotable to an alignment location for blocking and aligning fore-ends of the media on the loading table, and a transport-allowing location for allowing a medium picked up by the pickup member to be transported, a cam gear including a gear portion partially including a tooth-omitted portion, and a cam portion for switching the alignment member between the alignment location and the transport-allowing location at first and second rotating locations, a main gear, a swing arm pivotable about a same axis as a rotation axis of the main gear, and first and second swing gears supported by the swing arm to interlock with the main gear, selectively interlocking with the gear portion according to a rotating direction of the main gear, and rotating the cam gear to the first and second rotating locations.

According to one or more embodiments, a sheet processing apparatus may include the above-described sheet supplying apparatus, and a sheet processing unit configured to perform processing on a medium supplied by the sheet supplying apparatus.

According to one or more embodiments, an image forming apparatus may include a printing unit configured to form a visible toner image on a sheet via electrophotography, a fixing unit configured to fix the visible toner image on the sheet, the fixing unit including a fixing roller and a pressing roller that rotate in mesh with each other, a spring configured to provide an elastic force in a direction allowing the pressing roller to press the fixing roller, a release lever pivotable to a pressing location for providing a pressing force of the spring to the pressing roller, and a releasing location for releasing the pressing force of the spring, a cam gear including a gear portion partially including a tooth-omitted portion, and a cam portion for switching the release lever between the pressing location and the releasing location at first and second rotating locations, a main gear, a swing arm pivotable about a same axis as a rotation axis of the main gear, and first and second swing gears supported by the swing arm to interlock with the main gear, selectively interlocking with the gear portion according to a rotating direction of the main gear, and rotating the cam gear to the first and second rotating locations.

According to one or more embodiments, an image forming apparatus may include a printing unit configured to form a visible toner image on a plurality of photoconductors via electrophotography, a plurality of intermediate transfer rollers opposite the plurality of photoconductors, an intermediate transfer belt interposed between the plurality of intermediate transfer roller and the plurality of photoconductors, a spring configured to apply an elastic force to the plurality of intermediate transfer rollers such that the plurality of intermediate transfer rollers approach the plurality of photoconductors, a releasing member movable to a pressing location for allowing at least one of the plurality of intermediate transfer rollers to approach a photoconductor corresponding to the at least one intermediate transfer roller and a releasing location for spacing the at least one of the plurality of intermediate transfer rollers apart from the photoconductor corresponding to the at least one intermediate transfer roller, a cam gear including a gear portion partially including a tooth-omitted portion, and a cam portion for switching the releasing member between the pressing location and the releasing location at first and second rotating locations, a main gear, a swing arm pivotable about a same axis as a rotation axis of the main gear, and first and second swing gears supported by the swing arm to interlock with the main gear, selectively interlocking with the gear portion according to a rotating direction of the main gear, and rotating the cam gear to the first and second rotating locations.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
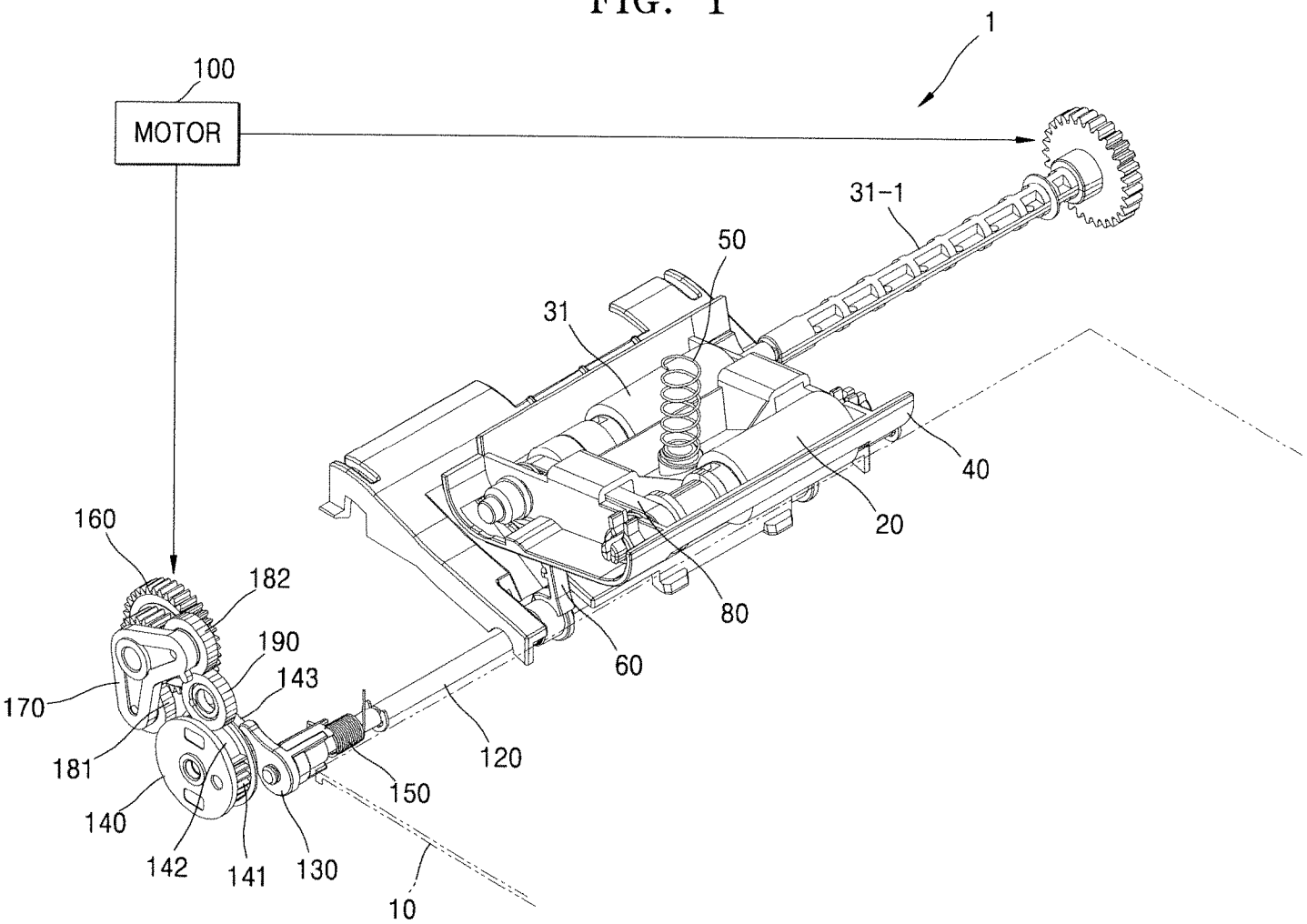
FIG. 1 is a perspective view of a sheet supplying apparatus according to an embodiment.

Embodiments of a sheet supplying apparatus, a sheet processing apparatus employing the sheet supplying apparatus, and an image forming apparatus will now be described with reference to the accompanying drawings. Like reference numerals in the drawings denote like elements, and, in the drawings, the sizes or thicknesses of elements may be exaggerated for clarity of explanation.

Figure 2:
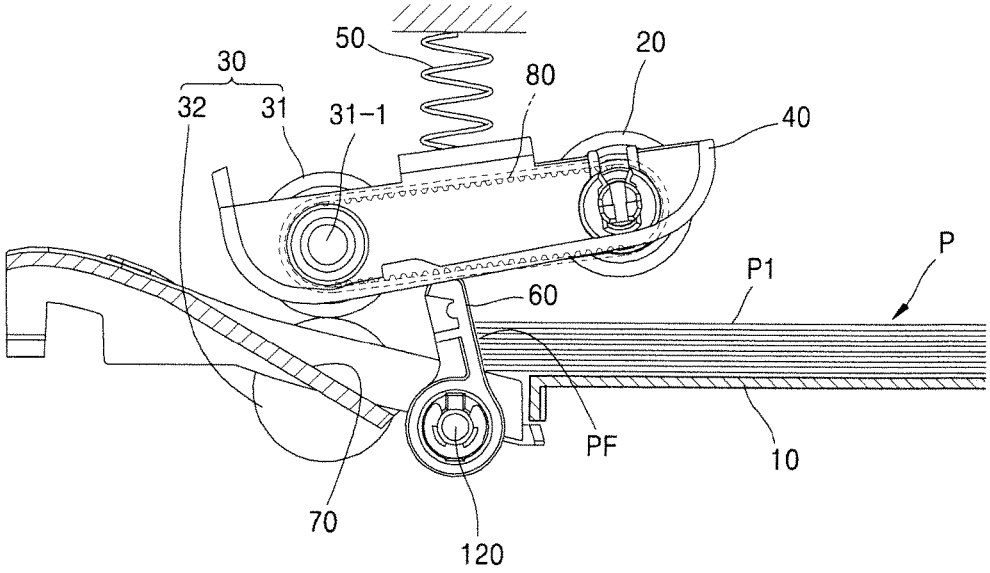
FIG. 2 is a schematic side view of a sheet supplying apparatus according to an embodiment.
Figure 3:
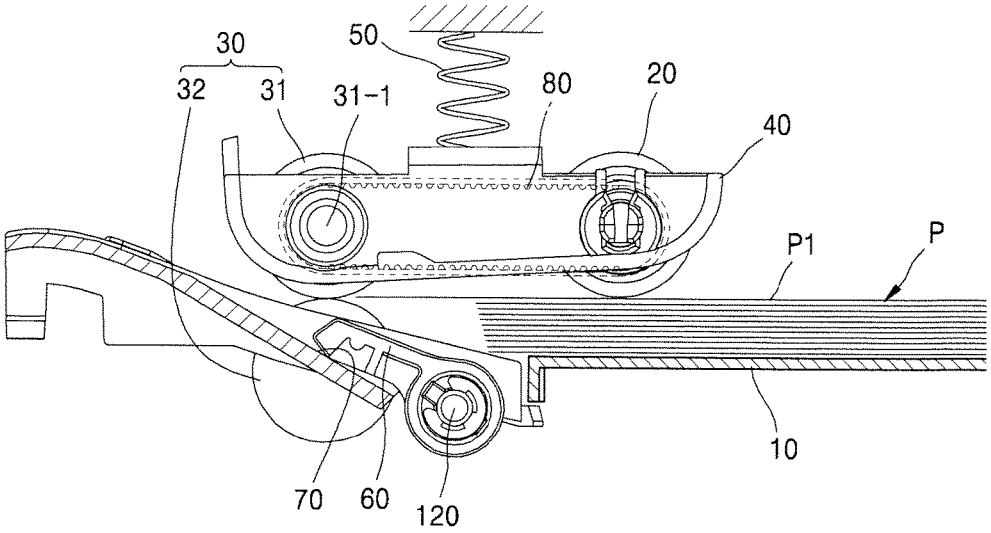
FIG. 3 is a schematic side view of a state of the sheet supplying apparatus of FIGS. 1 and 2 in which a pickup roller is positioned at a pickup location.

FIG. 1 is a perspective view of a sheet supplying apparatus 1 according to an embodiment. FIG. 2 is a schematic side view of the sheet supplying apparatus 1 according to an embodiment. FIG. 3 is a schematic side view of a state of the sheet supplying apparatus 1 in which a pickup roller 20 is positioned at a pickup location. Referring to FIGS. 1-3, the sheet supplying apparatus 1 may include a loading table 10 on which sheet-type media, for example, a cut sheet (hereinafter, referred to as papers), are placed, and the pickup roller (pickup member) 20 that picks up a sheet of paper P from the loading table 10. A pickup member is not limited to a roller type, and may be any of various types, such as, a belt type.

The pickup roller 20 is supported by a holder 40 that is pivotable. As shown in FIG. 3, the holder 40 is pivoted to a pickup location for allowing the pickup roller 20 to contact a sheet P1 at the top from among the papers P placed on the loading table 10. As shown in FIG. 2, the holder 40 is pivoted to a separating location for separating the pickup roller 20 from the sheet P1. The holder 40 is positioned at the pickup location when feeding is performed, and is positioned at the separating location when feeding is not performed.

When the pickup roller 20 rotates at the pickup location, the sheet P1 is picked up and fed out of the loading table 10. In some case, the sheet P1 and at least one sheet P2 below the sheet P1 may be guided out together, which is referred to as multi-feeding.

Figure 4:
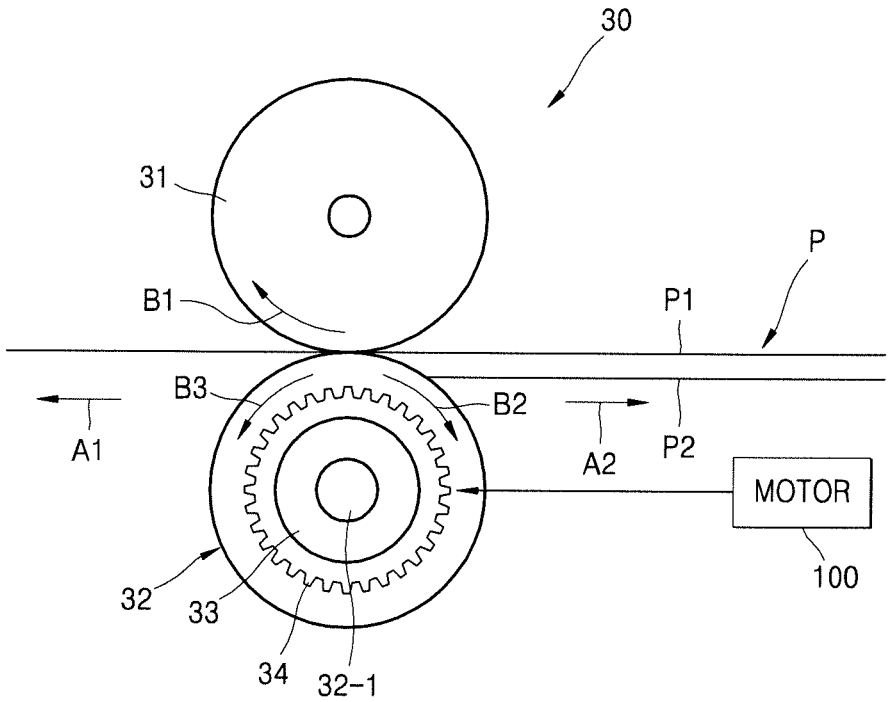
FIG. 4 is a schematic diagram of a separating unit having a retard-type separation structure, according to an embodiment.

The sheet supplying apparatus 1 may further include a separating unit 30 separating and transporting only one sheet, for example, only the sheet P1, when multi-feeding occurs. The separating unit 30 may have various structures, such as a friction separation structure and a retard-type separation structure. Because the structure of the separating unit 30 is well known, a separating unit 30 having a retard-type separation structure will now be described in brief. FIG. 4 is a schematic diagram of a separating unit 30 having a retard-type separation structure, according to an embodiment.

The separating unit 30 may include a feed roller 31, a retard roller 32, and a torque limiter 33. The feed roller 31 and the retard roller 32 rotate in mesh with each other. The feed roller 31 is connected to, for example, a motor 100, and is rotated in a first direction B1 such that the papers P are transported in a withdrawing direction A1. A driving force in a second direction B2 to transport the papers P in a direction A2 opposite the withdrawing direction A1 is transmitted from the motor 100 to the retard roller 32. The torque limiter 33 limits the driving force in the second direction B2 transmitted to the retard roller 32. The torque limiter 33 may have various well-known structures. For example, the torque limiter 33 may be implemented by a spring clutch structure. The torque limiter 33 may be provided between, for example, a rotation shaft 32-1 and the retard roller 32 or between a gear 34 transmitting the driving force of the motor 100 in the second direction B2 to the rotation shaft 32-1 and the rotation shaft 32-1.

The torque limiter 33 limits the driving force in the second direction B2 transmitted to the retard roller 32, according to the size of a load torque applied to the retard roller 32. When the load torque applied to the retard roller 32 is less than a threshold torque provided by the torque limiter 33, the driving force in the second direction B2 is transmitted to the retard roller 32, and thus the retard roller 32 rotates in the second direction B2. When the load torque applied to the retard roller 32 exceeds the threshold torque provided by the torque limiter 33, the driving force in the second direction B2 transmitted to the retard roller 32 is blocked by the torque limiter 33. In this case, the retard roller 32 is rotated in a third direction B3 by the feed roller 31.

A separating operation according to such a structure will now be described in brief.

When no paper P or only one sheet of paper P is guided between the feed roller 31 and the retard roller 32, the load torque applied to the retard roller 32 is greater than the threshold torque of the torque limiter 33, and thus the torque limiter 33 blocks the driving force toward the retard roller 32. Accordingly, the retard roller 32 rotates in the third direction B3 for transporting the papers P in the withdrawing direction A1 in corporation with the feed roller 31.

When at least two sheets of paper P, for example, the sheet P1 and the sheet P2, are guided between the feed roller 31 and the retard roller 32, the sheet P1 and the sheet P2 contact the feed roller 31 and the retard roller 32, respectively. At this time, friction between the sheet P1 and the sheet P2 is less than friction between the sheet P2 and the retard roller 32. Thus, a slip occurs between the sheet P1 and the sheet P2, and the load torque applied to the retard roller 32 is less than the threshold torque provided by the torque limiter 33. The retard roller 32 rotates in the second direction B2, and the sheet P2 is transported in the direction A2 opposite the withdrawing direction A1 by the retard roller 32. Accordingly, only the sheet P1 passes between the feed roller 31 and the retard roller 32 and is transported in the withdrawing direction A1.

The sheet supplying apparatus 1 may further include an alignment member 60. The alignment member 60 is positioned at an alignment location, as shown in FIG. 2, and provides an alignment criterion of fore-ends PF of the papers P when the papers P are placed on the loading table 10. At the alignment location, the fore-ends PF of the papers P placed on the loading table 10 contact the alignment member 60. The alignment member 60 may be switched to a transport-allowing location, as shown in FIG. 3, in order to allow a sheet picked up by the pickup roller 20 to be transported. The sheet supplying apparatus 1 may further include a stopper 70 that stops the alignment member 60 to not excessively rotate beyond the transport-allowing location.

Figure 5:
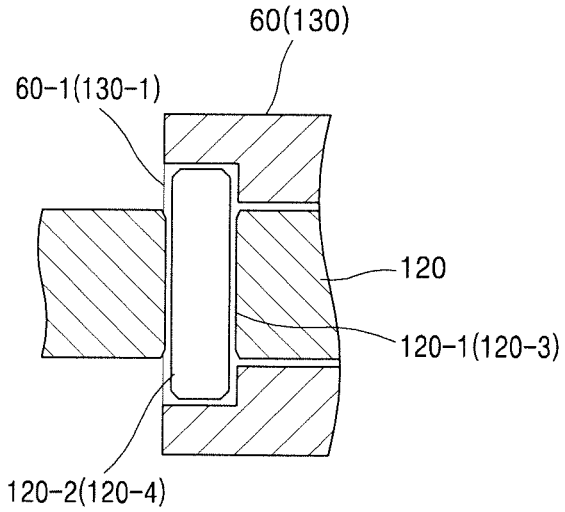
FIG. 5 is a cross-sectional view of an example of a structure for fixing a member to a pivoting shaft.

The alignment member 60 may be coupled to a pivoting shaft 120. FIG. 5 is a cross-sectional view of an example of a structure for fixing a member to the pivoting shaft 120. As shown in FIG. 5, a pin 120-2 is inserted into a pin hole 120-1 provided in the pivoting shaft 120. A pin accommodating portion 60-1, in which the pin 120-2 is accommodated, is provided on the alignment member 60. The alignment member 60 is inserted into the pivoting shaft 120 such that the pin 120-2 is seated on the pin accommodating portion 60-1. The alignment member 60 may be integrally formed with the pivoting shaft 120.

For example, the holder 40 is provided to be pivotable about a rotation shaft 31-1 of the feed roller 31. The pickup roller 20 rotates in connection with the feed roller 31. According to an embodiment, the pickup roller 20 is connected to the feed roller 31 via a timing belt 80, but a gear (not shown) may be used instead of the timing belt 80. In this case, an odd number of gears are employed so that the pickup roller 20 and the feed roller 31 rotate in the same direction.

A first elastic member 50 applies, to the holder 40, an elastic force in a direction allowing the holder 40 to be pivoted to the pickup location. For example, the first elastic member 50 may be one of various types of members including a compression coil spring, a tension coil spring, a torsion spring, and the like.

When the alignment member 60 pivots from the transport-allowing location to the alignment location, the alignment member 60 may push the holder 40 in a direction opposite a direction of the elastic force of the first elastic member 50 and pivots the holder 40 to the separating location. At the alignment location, the alignment member 60 supports the holder 40 and maintains the holder 40 at the separating location. When the alignment member 60 pivots from the alignment location to the transport-allowing location, the holder 40 pivots from the separating location to the pickup location due to the elastic force of the first elastic member 50.

According to this structure, without providing a torque limiter or a spring clutch on the feed roller 31 and the pickup roller 20, the pickup roller 20 may be switched between the pickup location and the separating location. Accordingly, a location of the pickup roller 20 may be switched without an increase in a driving load or generation of noise. Because a pressing force of pressing the pickup roller 20 down on the papers P is determined by the first elastic member 50, a stable pressing force may be applied to the pickup roller 20, and thus the risk of multi-feeding due to a difference between pressing forces applied may be reduced.

An example of a structure for switching the alignment member 60 between the alignment location and the transport-allowing location will now be described. According to an embodiment, the alignment member 60 is switched between the alignment location and the transport-allowing location by using a swinging operation of a gear without using a driver, such as a solenoid.

Referring to FIG. 1, a lever 130 is provided on one end of the pivoting shaft 120. The lever 130 may be fixed to the pivoting shaft 120. For example, as shown in FIG. 5, a pin 120-4 is inserted into a pin hole 120-3 provided in the pivoting shaft 120. A pin accommodating portion 130-1, in which the pin 120-4 is accommodated, is provided on the lever 130. The lever 130 is inserted into the pivoting shaft 120 such that the pin 120-4 is seated on the pin accommodating portion 130-1. The lever 130 may be integrally formed with the pivoting shaft 120.

Figure 6:
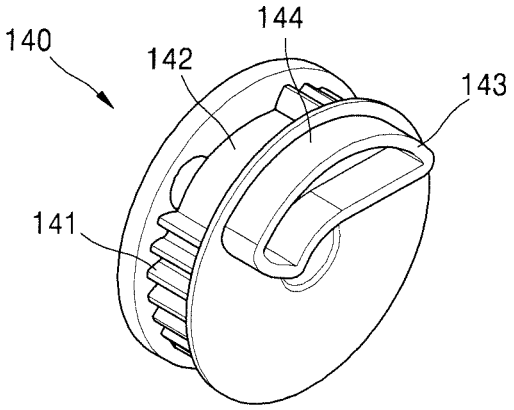
FIG. 6 is a perspective view of a cam gear according to an embodiment.

A cam gear 140 switches the alignment member 60 between the alignment location and the transport-allowing location according to a rotation phase of the cam gear 140. FIG. 6 is a perspective view of the cam gear 140 according to an embodiment. Referring to FIGS. 1 and 6, the cam gear 140 may include a gear portion 141 and a cam portion 143. A tooth-omitted portion 142 is partially provided on the gear portion 141. The cam portion 143 has a cam profile 144 for switching the alignment member 60 between the alignment location and the transport-allowing location. According to an embodiment, the cam portion 143 is connected to the lever 130. The cam portion 143 may contact the lever 130 and pivot the pivoting shaft 120 to switch the alignment member 60 to the alignment location. When the contact between the cam portion 143 and the lever 130 is terminated, the holder 40 presses the alignment member 60 due to the elastic force of the first elastic member 50, and thus the alignment member 60 may be pivoted to the transport-allowing location.

The sheet supplying apparatus 1 may further include a second elastic member 150 which provides an elastic force in a direction allowing the alignment member 60 to be switched to the transport-allowing location. For example, the second elastic member 150 applies, to the pivoting shaft 120, the elastic force in a direction allowing the alignment member 60 to be switched to the transport-allowing location. The second elastic member 150 may be not only a torsion spring, as shown in FIG. 1, but also may be any of various types of springs, such as a compression or tension coil spring, a plate spring, and the like.

The cam gear 140 is rotated by the motor 100. A main gear 160 is connected to the motor 100. A swing arm 170 is pivotable about the same axis as a rotation axis of the main gear 160. For example, the swing arm 170 may be pivotable about the rotation axis of the main gear 160. First and second swing gears 181 and 182 engage with the main gear 160.

Figure 7:
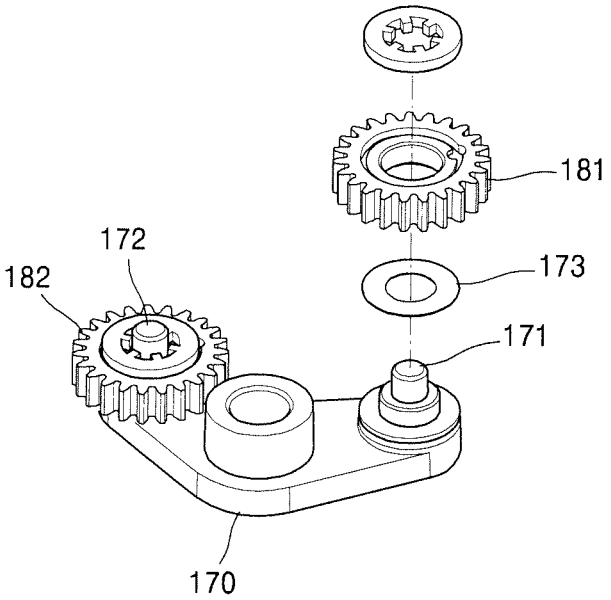
FIG. 7 is an exploded perspective view of a swing arm and first and second swing gears according to an embodiment.

FIG. 7 is an exploded perspective view of the swing arm 170 and the first and second swing gears 181 and 182 according to an embodiment. As shown in FIGS. 1 and 7, the first and second swing gears 181 and 182 are provided on the swing arm 170. First and second shafts 171 and 172 are provided on the swing arm 170. The first and second swing gears 181 and 182 are provided to be rotatable about the first and second shafts 171 and 172, respectively. A load providing member 173 providing a rotation load to the first and second swing gears 181 and 182 is interposed between each of the first and second swing gears 181 and 182 and the swing arm 170. The load providing member 173 may be, for example, a spring washer, a friction pad, or the like.

According to such a structure, the swing arm 170 pivots in the same direction as a rotation direction of the main gear 160. Thus, according to the rotation direction of the main gear 160, the first and second swing gears 181 and 182 are selectively connected to the gear portion 141 of the cam gear 140. In order to prevent changing of a rotation direction of the cam gear 140 even when the rotation direction of the main gear 160 is changed, an idle gear 190 is interposed between one of the first and second swing gears 181 and 182 and the gear portion 141. According to an embodiment, the idle gear 190 is interposed between the second swing gear 182 and the gear portion 141. The number of idle gears 190 is an odd number. According to an embodiment, the single idle gear 190 engages with the gear portion 141.

FIGS. 8A-8F are schematic side views for illustrating location switching of the alignment member 60 and the holder 40. An operation of the sheet supplying apparatus 1 according to the above-described structure will now be described with reference to FIGS. 8A-8F.

Figure 8A:
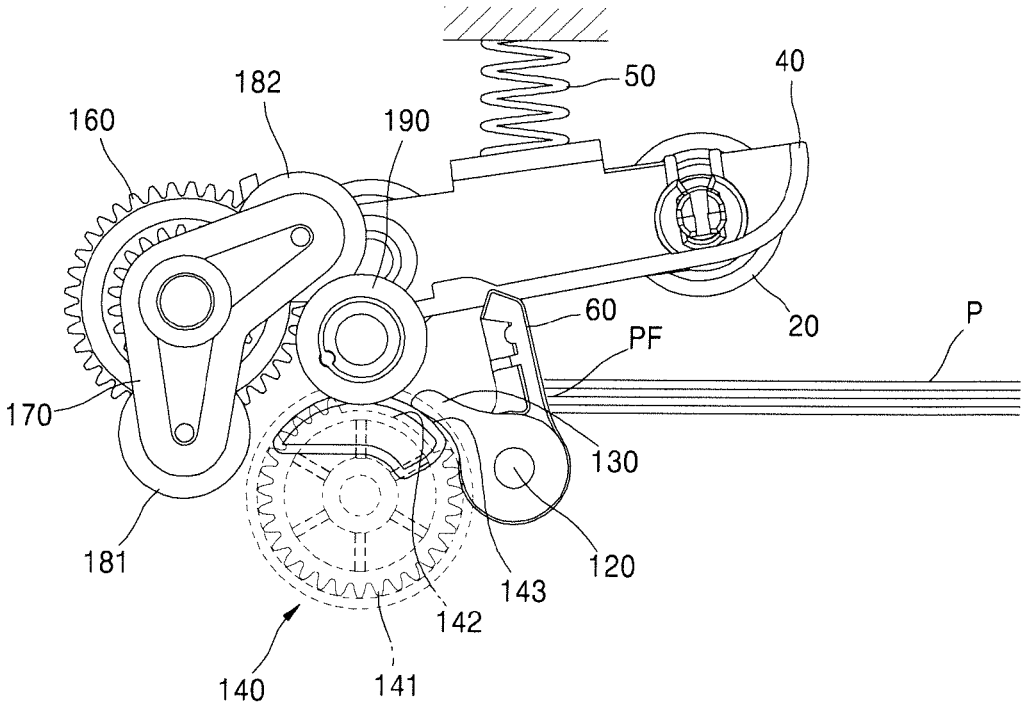
FIGS. 8A-8F are schematic side views for illustrating location switching of an alignment member and a holder.

Referring to FIG. 8A, the cam gear 140 is positioned at a first rotating location. The lever 130 contacts the cam portion 143, and thus the alignment member 60 is positioned at the alignment location. The holder 40 is supported by the alignment member 60 and positioned at the separating location. The second swing gear 182 is connected to the idle gear 190, and the idle gear 190 is positioned on the tooth-omitted portion 142. In this state, when the papers P are placed on the loading table 10, the fore-ends PF of the papers P contact the alignment member 60, and thus the papers P are aligned.

Figure 8B:
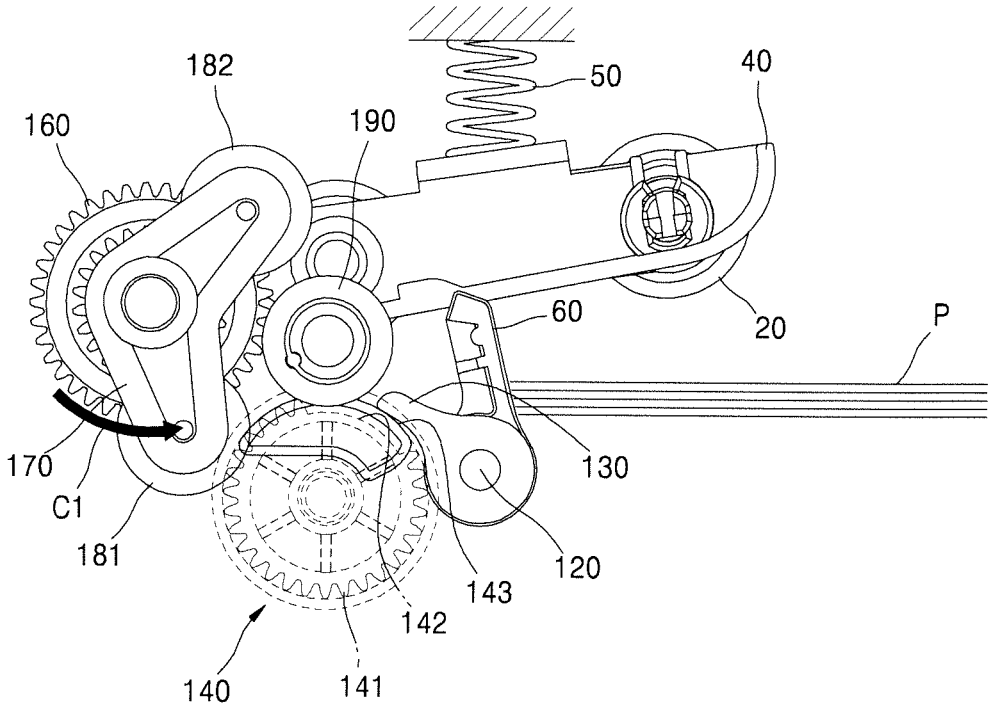

In the state shown in FIG. 8A, when the motor 100 rotates in a forward direction, the main gear 160 rotates in a direction C1, as shown in FIG. 8B. Then, the swing arm 170 is rotated in the direction C1, the second swing gear 182 is spaced apart from the idle gear 190, and the first swing gear 181 is connected to the gear portion 141.

Figure 8C:
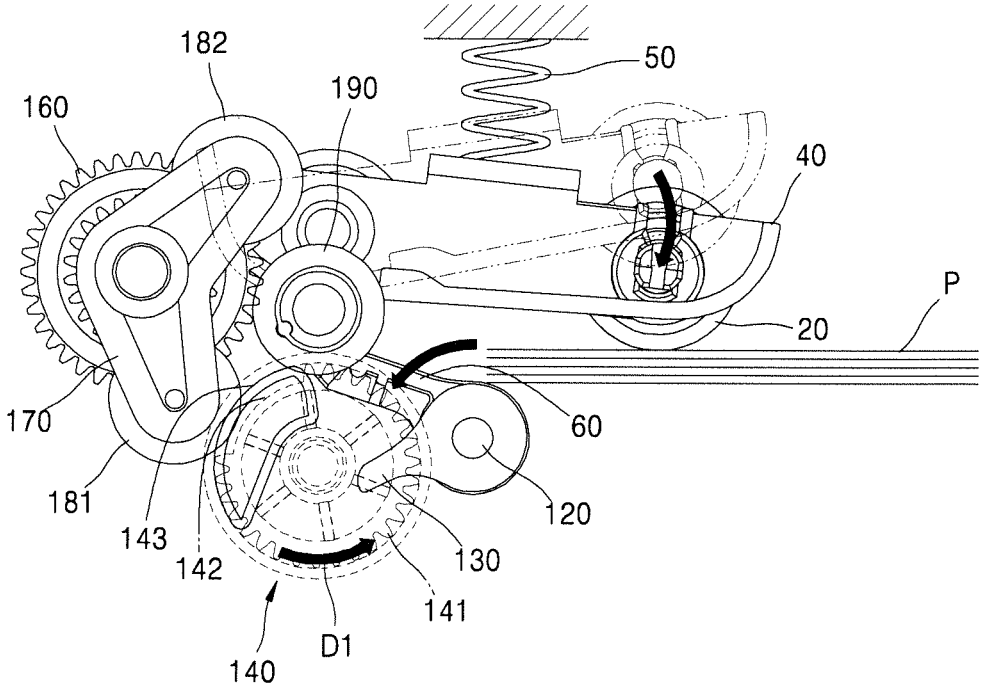

When the motor 100 continuously rotates in the forward direction, the cam gear 140 rotates in a direction D1, as shown in FIG. 8C. When the contact between the cam portion 143 and the lever 130 is terminated, the cam gear 140 reaches a second rotating location that allows the alignment member 60 to be switched to the transport-allowing location. The pivoting shaft 120 is pivoted due to the elastic force of the second elastic member 150, and the alignment member 60 is switched to the transport-allowing location. When the alignment member 60 reaches the transport-allowing location, the alignment member 60 contacts the stopper 70 of FIG. 3. Accordingly, the alignment member 60 is maintained at the transport-allowing location due to the elastic force of the second elastic member 150 and the stopper 70. The holder 40 is pivoted to the pickup location allowing the pickup roller 20 to contact the papers P, due to the elastic force of the first elastic member 50.

When the second elastic member 150 is not included, the alignment member 60 may be pushed by the holder 40 pivoted to the pickup location due to the elastic force of the first elastic member 50 and thus pivoted to the transport-allowing location, and consequently the alignment member 60 may contact the stopper 70.

When the contact between the cam portion 143 and the lever 130 is terminated, namely, when the cam gear 140 reaches the second rotating location, the first swing gear 181 is positioned on the tooth-omitted portion 142. The idle gear 190 deviates from the tooth-omitted portion 142 and is connected to the gear portion 141, but the second swing gear 182 is spaced apart from the idle gear 190. Thus, in this state, even when the motor 100 rotates in the forward direction, the cam gear 140 does not rotate, and a sheet P is guided out of the loading table 10 by the pickup roller 20.

When feeding of the sheet P is completed, an operation of switching the alignment member 60 to the alignment location and the holder 40 to the separating location is performed.

Figure 8D:
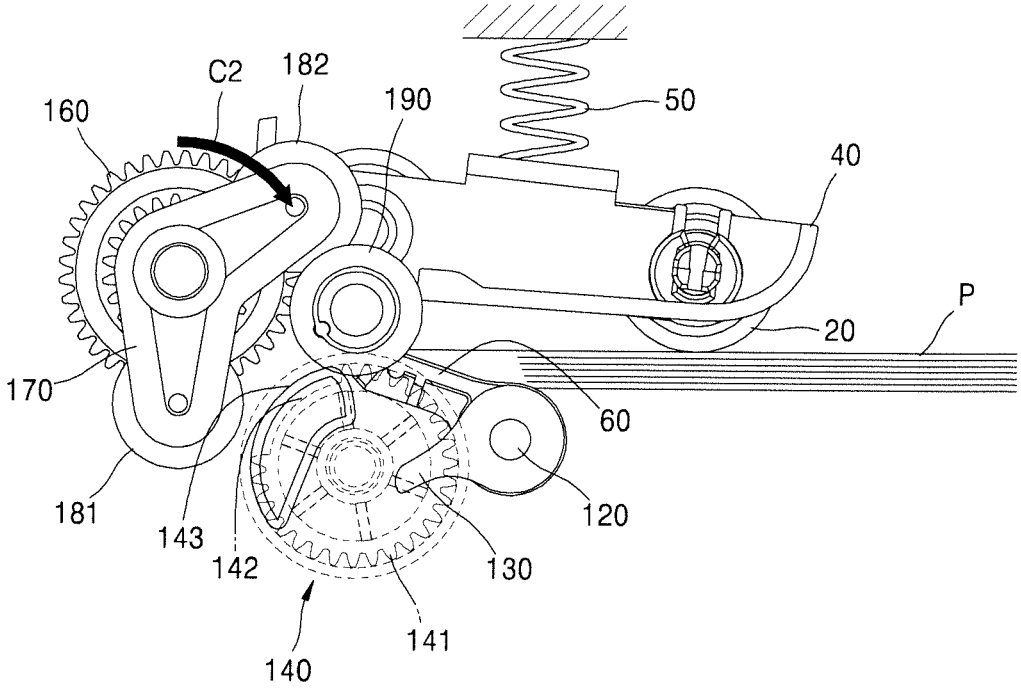

The motor 100 rotates in a backward direction. As shown in FIG. 8D, the main gear 160 rotates in a direction C2. Then, the swing arm 170 is rotated in the direction C2, the first swing gear 181 is spaced apart from the tooth-omitted portion 142, and the second swing gear 182 is connected to the idle gear 190. The idle gear 190 is connected to the gear portion 141.

Figure 8E:
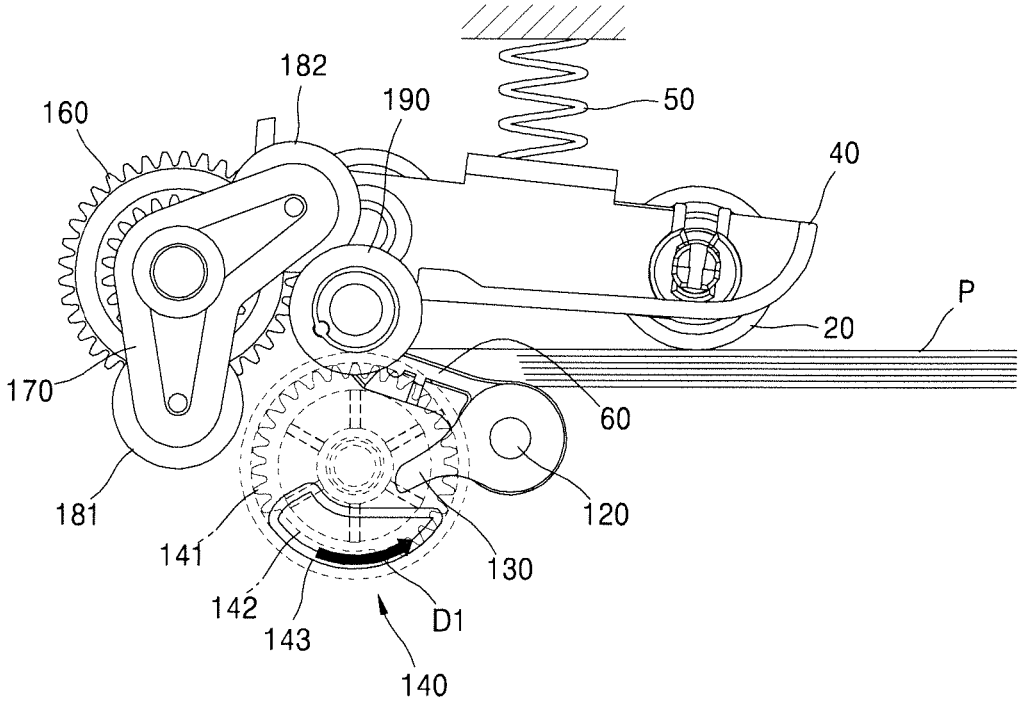

When the motor 100 continuously rotates in the backward direction, the cam gear 140 rotates in the direction D1, as shown in FIG. 8E. The cam portion 143 contacts the lever 130. As the cam gear 140 rotates in the direction D1, the cam portion 141 pushes the lever 130, and the pivoting shaft 120 is pivoted in a direction opposite to a direction of the elastic force of the second elastic member 150. The alignment member 60 is pivoted from the transport-allowing location to the alignment location. When the cam gear 140 continuously rotates in the direction D1 while the alignment member 60 is in contact with the holder 40, the alignment member 60 pushes the holder 40 in the direction opposite to the direction of the elastic force of the first elastic member 50 while being pivoted to the alignment location. The holder 40 is pivoted toward the separating location.

Figure 8F:
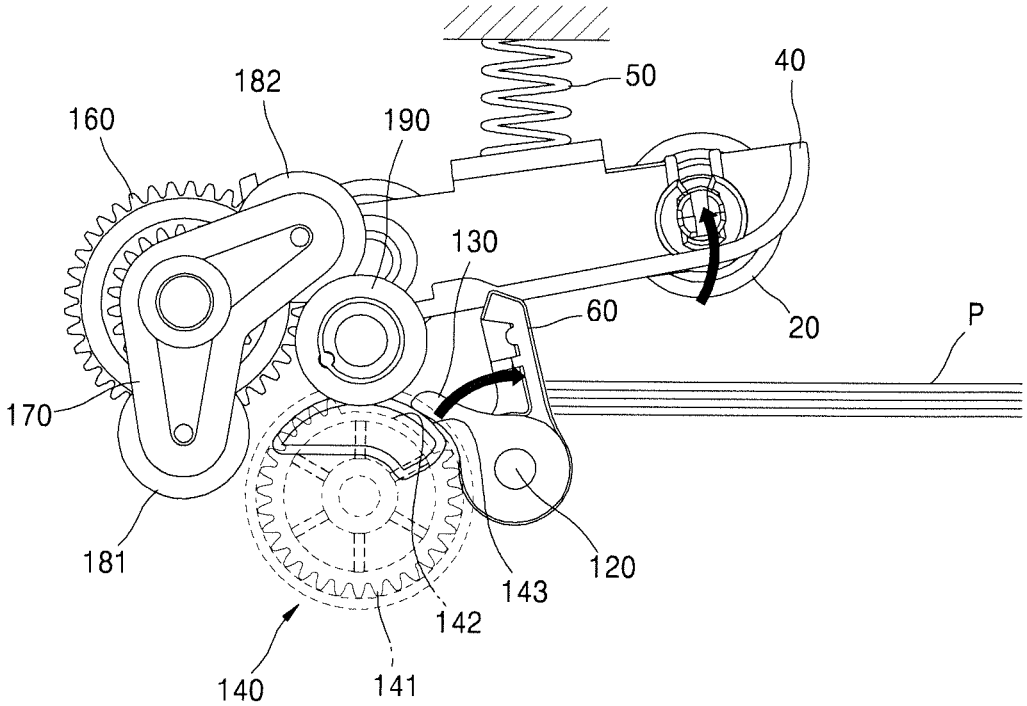

As shown in FIG. 8F, when the alignment member 60 reaches the alignment location, the holder 40 reaches the separating location. At this time, the idle gear 190 is positioned on the tooth-omitted portion 142, and the cam gear 140 reaches the first rotating location. Accordingly, the rotation force of the motor 100 in the backward direction is not transmitted to the cam gear 140, and the cam gear 140 is stopped. Because the lever 130 is supported by the cam portion 143, the alignment member 60 maintains the alignment location, and the holder 40 is supported by the alignment member 60 and thus maintains the separating location.

When an abnormal feeding-terminated situation occurs, such as, when a jam occurs during feeding or when the sheet supplying apparatus 1 is powered off, an operation of addressing the abnormal feeding-terminated situation and then initializing the location of the cam gear 140 may be needed. In this case, the motor 100 rotates in the forward direction for a certain period of time. Then, the cam gear 140 is positioned at the second rotating location, as shown in FIG. 8C. In this state, when the motor 100 rotates in the backward direction again, the cam gear 140 may reach the first rotating location, as shown in FIG. 8A. A time period for the rotation in the forward direction and a time period for the rotation in the backward direction are long enough as one rotation of the cam gear 140.

The shape of the cam profile 144 of the cam portion 143 and a connection structure between the cam portion 143 and the lever 130 are not limited to the aforementioned examples. The shape of the cam profile 144 of the cam portion 143 and the connection structure between the cam portion 143 and the lever 130 may be implemented as various embodiments capable of switching the alignment member 60 between the alignment location and the transport-allowing location.

As such, without employing an additional driving source, such as a solenoid, the alignment member 60 may be switched between the alignment location and the transport-allowing location and the holder 40 may be switched between the pickup location and the separating location, due to the forward rotation and the backward rotation of the motor 100 for driving the sheet supplying apparatus 1. Thus, costs for manufacturing the sheet supplying apparatus 1 may be reduced.

Figure 9:
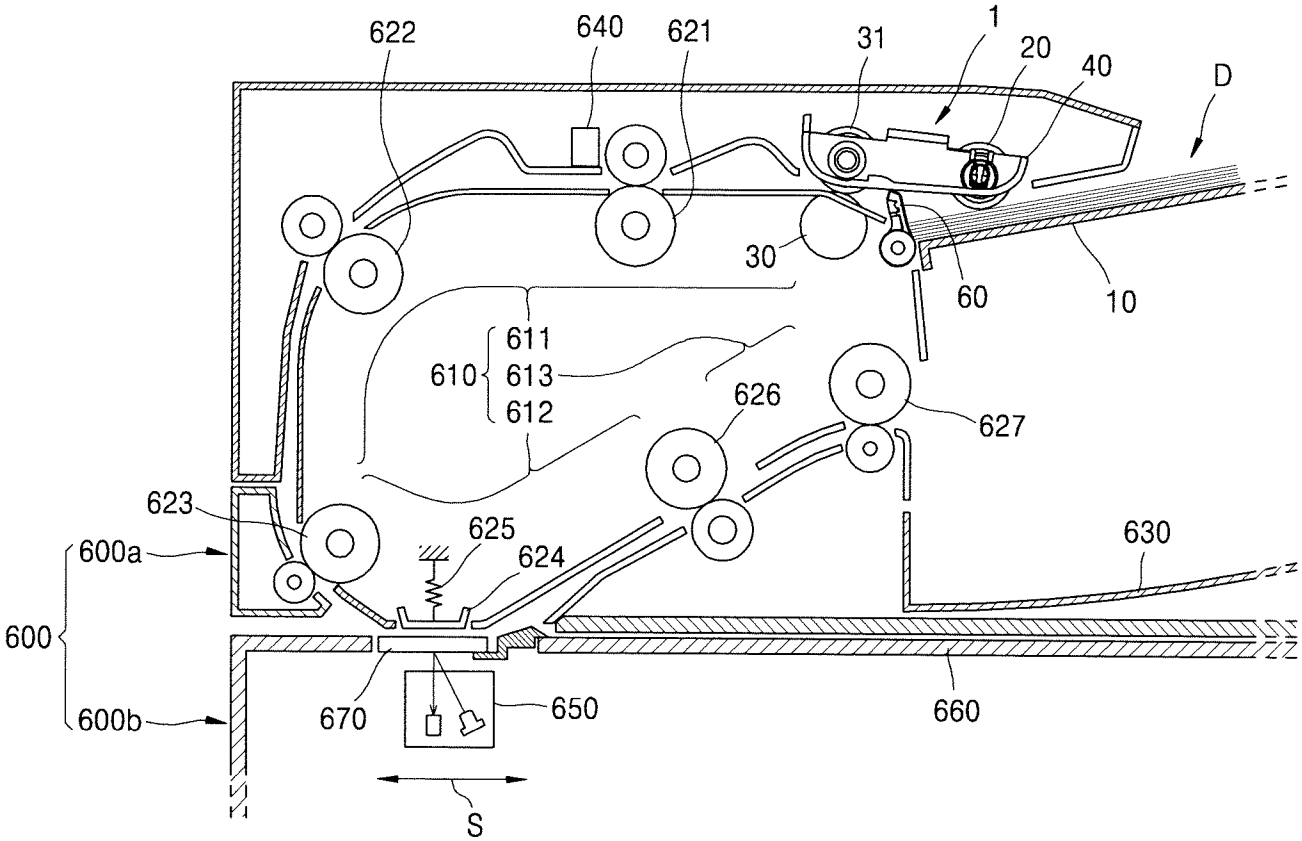
FIG. 9 is a schematic diagram of a scanner employing a sheet supplying apparatus, according to an embodiment.

The above-described sheet supplying apparatus 1 is applicable to various apparatuses (sheet processing apparatuses). FIG. 9 is a schematic diagram of a scanner 600 employing a sheet supplying apparatus 1, according to an embodiment. Referring to FIG. 9, the scanner 600 may include the sheet supplying apparatus 1, and a sheet processing unit which reads out an image from a document D supplied by the sheet supplying apparatus 1 while transporting the document D. The sheet processing unit may include a document transport unit 600*a* and a read unit 600*b* reading an image from the document D. The sheet supplying apparatus 1 employed in the scanner 600 is the above-described sheet supplying apparatus 1. Because the scanner 600 reads an image recorded on a document, the sheet supplying apparatus 1 supplies the document D.

The read unit 600*b* may include a read member 650 for reading an image from the document D. The read member 650 radiates light to the document D, and receives light reflected by the document D to thereby read the image from the document D. For example, a contact type image sensor (CIS), a charge-coupled device (CCD), or the like may be employed as the read member 650.

Types of the scanner 600 include a flatbed type in which the document D is located in a fixed location and a read member, such as a CIS or a CCD, reads an image from the document D while moving, a document feed type in which the read member is located in a fixed location and the document D is transported, and a combination of the two types. The scanner 600 according to an embodiment is a scanner of a combination of the flatbed type and the document feed type.

The read unit 600*b* further may include a platen glass 660 on which the document D is placed so that an image is read from the document D using a flatbed method. The read unit 600*b* further may include a read window 670 for reading an image from the document D therethrough by using a document feed method. The read window 670 may be, for example, a transparent member. For example, a top surface of the read window 670 may be at a same level as a top surface of the platen glass 660.

When the document feed method is applied, the read member 650 is located below the read window 670. When the flatbed method is applied, the read member 650 may be moved from below the platen glass 660 in a sub-scanning direction S, namely, a lengthwise direction of the document D, by a transportation unit (not shown). Moreover, when the flatbed method is applied, the platen glass 660 needs to be exposed to the outside such that the document D is placed thereon. To this end, the document transport unit 600*a* may expose the platen glass 660 by being pivoted with respect to the read unit 600*b*.

The document transport unit 600*a* transports the document D such that the read member 650 may read an image from the document D, and discharges the document D from which an image has been read. To this end, the document transport unit 600*a* may include a document transport path 610, and the read member 650 reads an image from the document D transported along the document transport path 610. For example, the document transport path 610 may include a supply path 611, a read path 612, and a discharge path 613. The read member 650 is disposed on the read path 612, and, while the document D is passing the read path 612, the image recorded on the document D is read out by the read member 650. The supply path 611 is used to supply the document D to the read path 612, and the document D placed on the loading table 10 is supplied to the read path 612 via the supply path 611. The discharge path 613 is used to discharge the document D that has passed the read path 612. Accordingly, the document D placed on the loading table 10 is transported along the supply path 611, the read path 612, and the discharge path 613 and is discharged to a discharge tray 630.

Transporting rollers 621 and 622 for transporting the document D led out of the loading table 10 by the sheet supplying apparatus 1 may be arranged on the document transport path 610. Each of the transporting rollers 621 and 622 has a structure in which a driving roller and a driven roller rotate in mesh with each other.

Transporting rollers 623 and 626 transporting the document D may be arranged on the read path 612. For example, the transporting rollers 623 and 626 transporting the document D may be arranged on both sides of the read member 650, respectively. Each of the transporting rollers 623 and 626 has a structure in which a driving roller and a driven roller rotate in mesh with each other. A read guiding member 624 opposite to the read member 650 is disposed on the read path 612. The read guiding member 624 presses the read window 670 by the own weight of the read guiding member 624 or by an elastic member 625, and the document D is transported between the read window 670 and the read guiding member 624. Although not shown in FIG. 9, a read roller that rotates while elastically pressuring the read window 670 and transports the document D supplied between the read roller and the read window 670 may be used instead of the read guiding member 624.

A discharge roller 627 discharging the document D on which reading has been completed is disposed on the discharge path 613. The discharge roller 627 has a structure in which a driving roller and a driven roller rotate in mesh with each other.

According to this structure, the document D supplied by the sheet supplying apparatus 1 may be transported along the supply path 611, the read path 612, and the discharge path 613, and the read member 650 may read an image from the document D.

The shape of the scanner 600 is not limited to the example of FIG. 9. For example, for double-sided reading, the scanner 600 may further include a path (re-transporting path) for transporting a document D having one read side back to a transporting roller 623 by rotating the discharge roller 627 in a backward direction. Alternatively, for double-sided reading, another read member 650 for reading an image from the other side of the document D may be disposed on an upstream side of the discharge roller 627.

Figure 10:
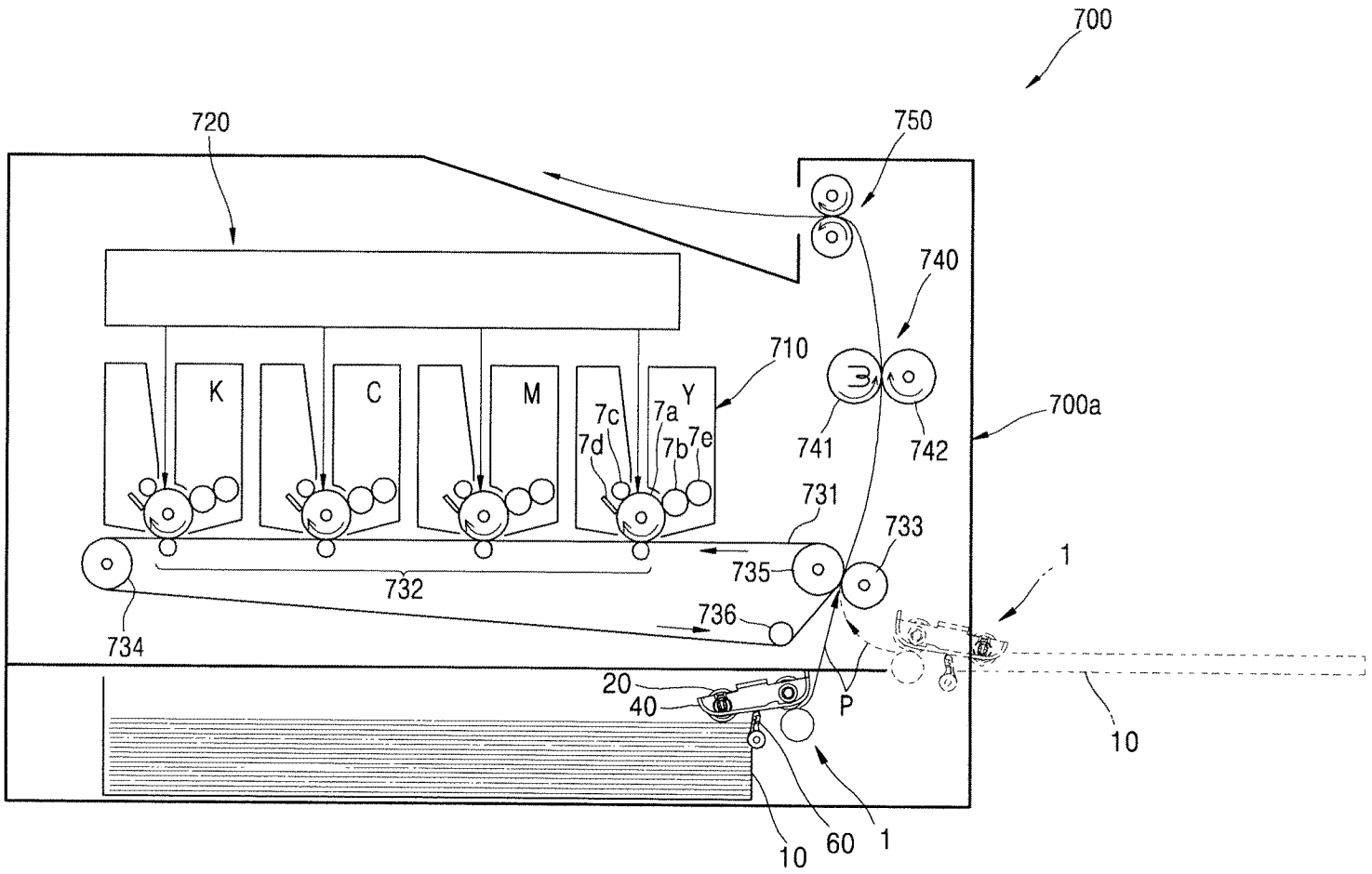
FIG. 10 is a schematic diagram of an image forming apparatus employing a sheet supplying apparatus, according to an embodiment.

FIG. 10 is a schematic view of an image forming apparatus 700 employing a sheet supplying apparatus 1, according to an embodiment. Referring to FIG. 10, the image forming apparatus 700 may include the sheet supplying apparatus 1, and a printing unit (sheet processing unit) 700*a* which prints an image on a sheet P supplied by the sheet supplying apparatus 1. As shown by a solid line of FIG. 10, the sheet supplying apparatus 1 may be placed as a cassette feeder, below the printing unit 700*a*. As shown by a dashed line of FIG. 10, the sheet supplying apparatus 1 may be implemented as a multi-purpose tray (MPT) placed on one lateral side of the printing unit 700*a*.

The printing unit 700*a* according to an embodiment may print an image on the sheet P according to any of various methods, such as electrophotography, inkjet printing, thermal transfer printing, and thermal sublimation. The image forming apparatus 700 according to an embodiment prints a color image to the sheet P via electrophotography. Referring to FIG. 10, the printing unit 700*a* may include a plurality of developing units 710, an exposure unit 720, a transfer unit, and a fixing unit 740.

For color printing, the plurality of developing units 710 may include four developing units 710 for developing images with cyan (C) color, magenta (M) color, yellow (Y) color, and black (K) color, respectively. Toners with cyan (C) color, magenta (M) color, yellow (Y) color, and black (K) color may be contained in the four developing units 710, respectively. The printing unit 700*a* further may include developing units 710 for containing and developing toners of other various colors such as a light magenta color, a white color, or the like.

Each developing unit 710 may include a photoconductive drum 7*a*. The photoconductive drum 7*a*, as a photoconductor on which an electrostatic latent image is formed, may include a conductive metal pipe and a photosensitive layer formed at an outer circumference of the conductive metal pipe. A charging roller 7*c* is an example of a charger that charges a surface of the photosensitive drum 7*a* to have a uniform surface potential. A cleaning blade 7*d* is an example of a cleaning member that removes residual toners and foreign substances attached to the surface of the photosensitive drum 7*a* after a transfer process to be described below.

The developing unit 710 supplies a toner contained therein to an electrostatic latent image formed on the photoconductive drum 7*a*, thereby developing the electrostatic latent image to a visible toner image. A developing method may include a one-component developing method using a toner and a two-component developing method using a toner and a carrier. In an embodiment, the developing unit 710 employs the one-component developing method. A developing roller 7*b* supplies a toner to the photoconductive drum 7*a*. A developing bias voltage may be applied to the developing roller 7*b* to supply the toner to the photosensitive drum 7*a*.

The one-component developing method may be classified into a contact developing method in which the developing roller 7*b* and the photoconductive drum 7*a* rotate in contact with each other, or a non-contact developing method in which the developing roller 7*b* and the photoconductive drum 7*a* are spaced apart from each other by several tens to several hundreds of micrometers and rotate. A supply roller 7*e* supplies the toner in the developing unit 710 to a surface of the developing roller 7*b*. A supply bias voltage for supplying the toner in the developing unit 710 to a surface of the developing roller 7*b* may be applied to the supply roller 7*e*.

The exposure unit 720 radiates light modulated in correspondence with image information onto the photoconductive drum 7*a* and forms the electrostatic latent image on the photoconductive drum 7*a*. Examples of the exposure unit 720 may include a laser scanning unit (LSU) using a laser diode as a light source and a light emitting diode (LED) exposure unit using an LED as a light source.

The transfer unit may include an intermediate transfer belt 731, an intermediate transfer roller 732, and a transfer roller 733. The intermediate transfer belt 731 temporarily receives a toner image developed on the photoconductive drum 7*a* of each of the four developing units 710. The intermediate transfer belt 731 is circulated while being supported by supporting rollers 734, 735, and 736. Four intermediate transfer rollers 732 are positioned to face the photoconductive drums 7*a* of the four developing units 710 with the intermediate transfer belt 731 therebetween. A first transfer bias voltage is applied to the four intermediate transfer rollers 732 so as to firstly transfer toner images, which are developed on the photosensitive drums 7*a*, to the intermediate transfer belt 731. The transfer roller 733 is positioned to face the intermediate transfer belt 731. A second transfer bias voltage is applied to the transfer roller 733 so as to transfer, to the sheet P, the toner images that are firstly-transferred to the intermediate transfer belt 731.

When a print command is transmitted from a host (not shown) or the like, a controller (not shown) charges, by using the charging roller 7*c*, the surface of the photoconductive drum 7*a* to have a uniform surface potential. The exposure unit 720 forms electrostatic latent images on the photoconductive drums 7*a* by scanning four light-beams to the photoconductive drums 7*a* of the four developing unit 710, the four light-beams being modulated according to image information corresponding to cyan, magenta, yellow, and black colors, respectively. The developing rollers 7*b* of the four developing units 710 supply C, M, Y, and K toners to the photoconductive drums 7*a*, respectively, thereby developing the electrostatic latent images into visible toner images. The developed toner images are firstly transferred to the intermediate transfer belt 731. The sheet P from the sheet supplying apparatus 1 is transported to a transfer nip formed by the transfer roller 733 and the intermediate transfer belt 731. The toner images that are firstly-transferred to the intermediate transfer belt 731 are secondly transferred to the sheet P due to the second transfer bias voltage applied to the transfer roller 733. When the sheet P passes through the fixing unit 740, the toner images are fixed on the sheet P due to heat and pressure. The sheet P on which fixing has been completed is externally discharged by a discharging roller 750.

Figure 11:
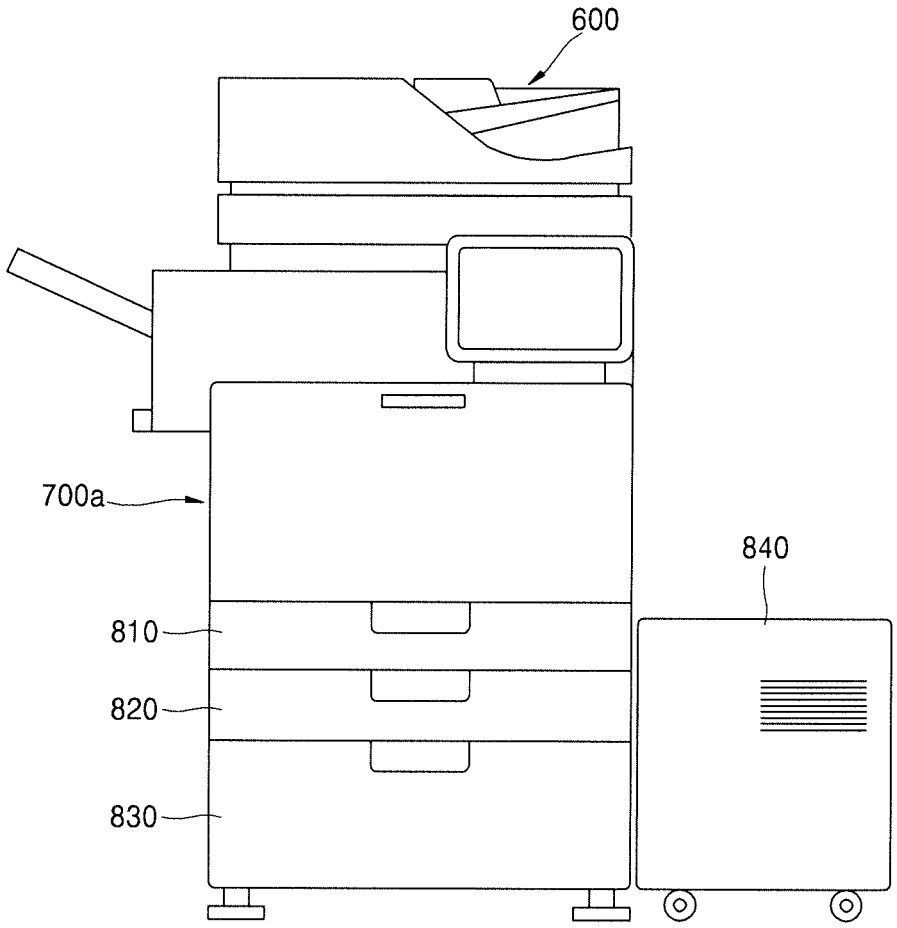
FIG. 11 is a schematic diagram of a multi-function printer according to an embodiment.

The scanner 600 and the image forming apparatus 700 may be used as independent apparatuses or as a combination of a scanner and an image forming apparatus. FIG. 11 is a schematic diagram of a multi-function printer according to an embodiment.

Referring to FIG. 11, the scanner 600 is disposed on the printing unit 700*a*. The structures of the scanner 600 and the printing unit 700*a* have already been described above with reference to FIGS. 9 and 10. The sheet supplying apparatus 1 supplying a sheet P to the printing unit 700*a* may be implemented in various types. For example, the sheet supplying apparatus 1 may be realized as an MPT placed on a lateral side of the printing unit 700*a*, a main cassette feeder 810 provided below the printing unit 700*a*, a secondary cassette feeder 820 provided below the main cassette feeder 810, a high capacity feeder 830 provided below the main cassette feeder 810 or the secondary cassette feeder 820, or a high capacity feeder 840 provided on a lateral side of the printing unit 700*a*, as shown in FIG. 11.

The swing arm 170, the first and second swing gears 181 and 182, and the cam gear 140 described above may change a mode of an object via forward and backward rotations of a motor. This structure is applicable to various fields. For example, referring back to FIG. 10, the fixing unit 740 may include a fixing roller 741 and a pressing roller 742 rotating in mesh with each other. The pressing roller 742 presses and contacts the fixing roller 741. When a jam occurs during printing, a pressing force applied to the pressing roller 742 may be released to handle the jam. To this end, a special driving source may be employed. In this case, costs of image forming apparatuses may increase. By employing the swing arm 170, the first and second swing gears 181 and 182, and the cam gear 140 described above, the pressing force applied to the pressing roller 742 may be released by using forward rotation and backward rotation of a motor for driving the fixing roller 741.

Figure 12:
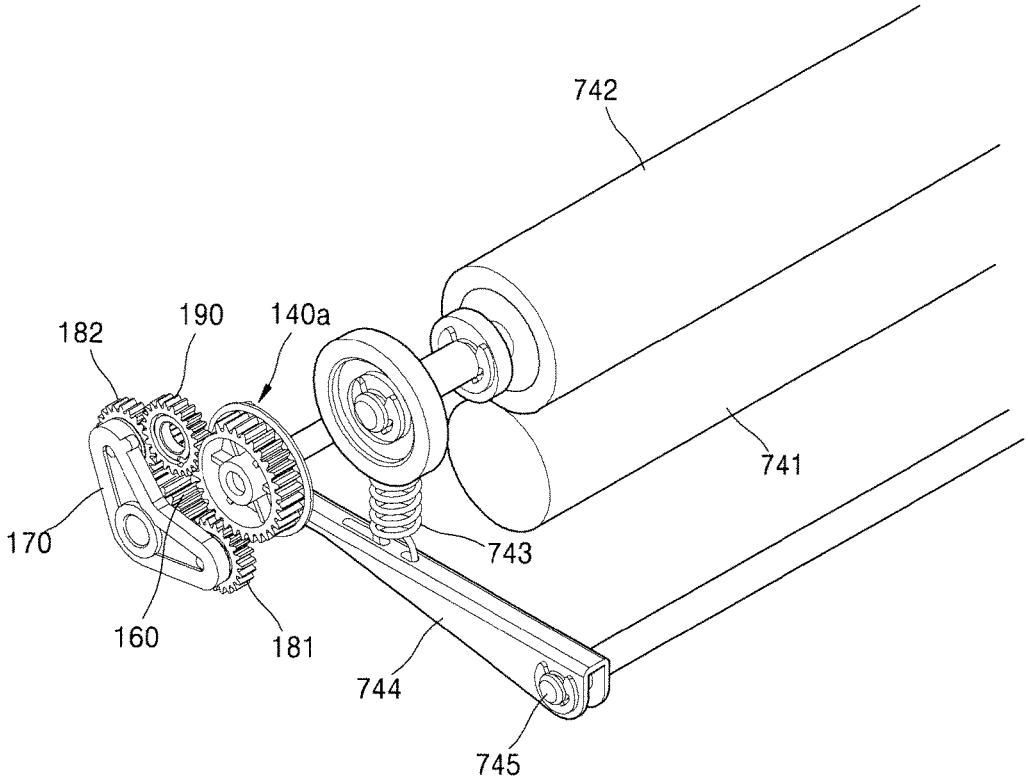
FIG. 12 is a schematic perspective view of a fixing unit of FIG. 10, according to an embodiment.

FIG. 12 is a schematic perspective view of the fixing unit 740 of FIG. 10 according to an embodiment. FIGS. 13A-13D are side views illustrating a process of forming/releasing a pressing force. Referring to FIGS. 12 and 13A-13D, a spring 743 presses the pressing roller 742 toward the fixing roller 741. For example, the spring 743 is a tension coil spring. A release lever 744 is supported to be pivotable about a pivoting shaft 745. One end of the release lever 744 contacts a cam portion 143*a*. One end of the spring 743 is connected to the pressing roller 742, and the other end thereof is connected to the release lever 744.

Figure 13A:
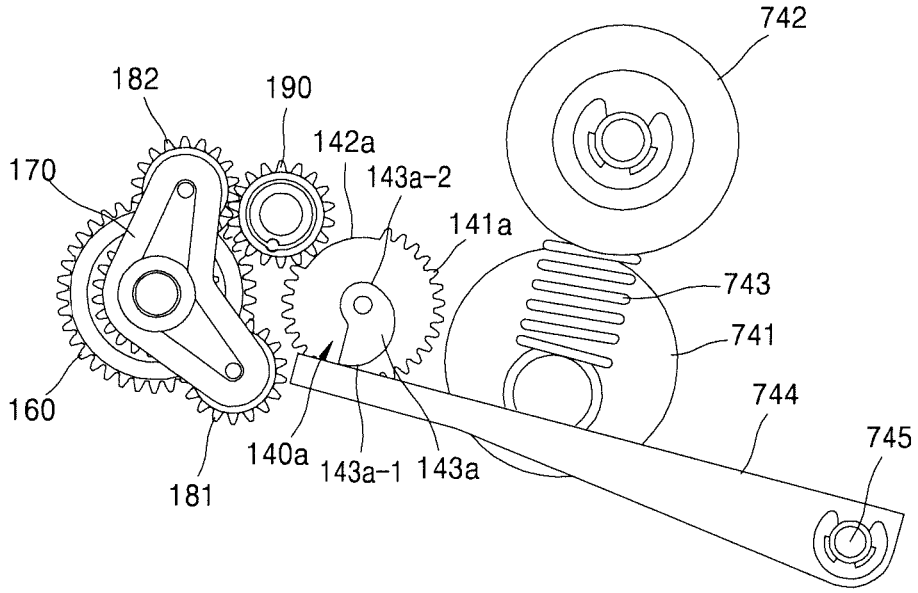
FIGS. 13A-13D are side views illustrating a process of forming/releasing a pressing force.

Referring to FIG. 13A, a cam gear 140*a* is positioned at a first rotating location. The release lever 744 contacts a top dead portion 143*a*-1 of the cam portion 143*a*, and extends the spring 743 and is positioned at a pressing location for pressing the pressing roller 742 toward the fixing roller 741. A second swing gear 182 is connected to an idle gear 190, and the idle gear 190 is positioned at a tooth-omitted portion 142*a*. A first swing gear 181 is spaced apart from a gear portion 141*a*. Even when a main gear 160 rotates in a forward direction, the cam gear 140*a* is not rotated, and the release lever 744 is maintained at the pressing location. In this state, printing may be performed.

Figure 13B:
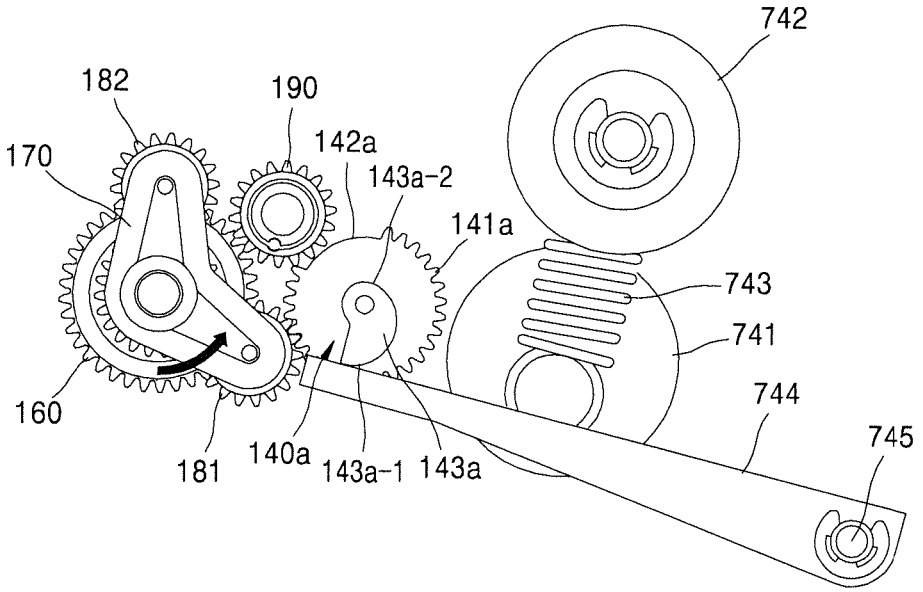

When the pressing force needs to be released, the main gear 160 rotates in a backward direction. Then, as shown in FIG. 13B, a swing arm 170 rotates in the same direction as the rotating direction of the main gear 160, and the first swing gear 181 is connected to the gear portion 141*a*. The second swing gear 182 is spaced apart from the idle gear 190.

Figure 13C:
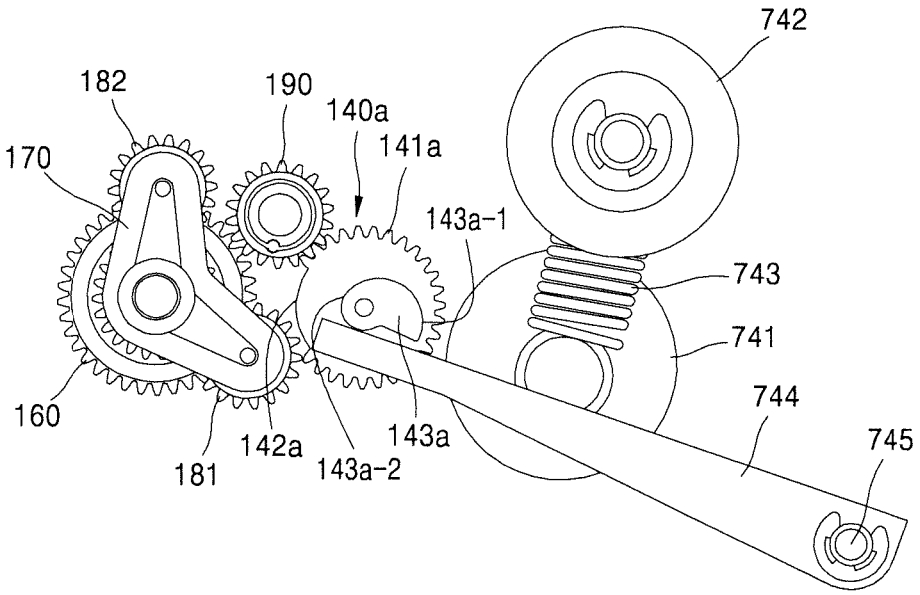

When the main gear 160 continuously rotates in the backward direction, the cam gear 140*a* rotates as shown in FIG. 13C, and thus the release lever 744 contacts a bottom dead portion 143*a*-2 of the cam portion 143*a*, and the release lever 744 is pivoted in a direction shortening the spring 743 and is thus positioned at a releasing location. Thus, the pressing force applied to the pressing roller 742 by the spring 743 is reduced or released. At this time, the first swing gear 181 is positioned on the tooth-omitted portion 142*a*, and the cam gear 140*a* reaches a second rotating location.

To perform printing again, an operation of switching the release lever 744 to the pressing location is performed.

Figure 13D:
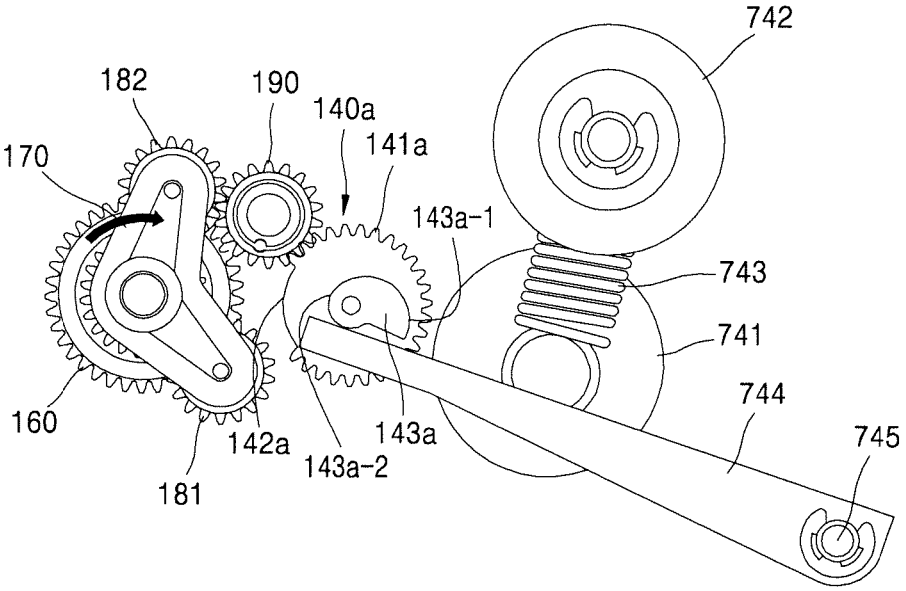

When the main gear 160 rotates in the forward direction, the second swing gear 182 is connected to the idle gear 190, as shown in FIG. 13D, and the first swing gear 181 is spaced apart from the tooth-omitted portion 141*a*. When the main gear 160 continuously rotates in the forward direction, as shown in FIG. 13A, the cam gear 140*a* returns to the first rotating location. The release lever 744 is positioned at a pressing location where the release lever 744 contacts the top dead portion 143*a*-1, and the pressing roller 742 is pressed toward the fixing roller 741 by the spring 743. The idle gear 190 is positioned at the tooth-omitted portion 142*a*, and, even when the main gear 160 rotates in the forward direction, the cam gear 140*a* does not rotate. In this state, printing may be performed.

The main gear 160 may be rotated by a motor (not shown) for driving the pressing roller 742 and the fixing roller 741. The motor (not shown) may drive the other components of the image forming apparatus 700. According to the above-described structure, the pressing force may be released/formed by using the motor that drives the fixing unit 740, without employing a special driving source.

Referring back to FIG. 10, the intermediate transfer rollers 732 are pressed toward the photoconductive drums 7*a* to form a transfer nip between the photoconductive drums 7*a* and the intermediate transfer belt 731. When a color image is printed, all of the four intermediate transfer rollers 732 may be positioned at pressing locations for pressing the photoconductive drums 7*a* of the four developing units 710 respectively corresponding to the four intermediate transfer rollers 732. When a single-color image, namely, a K color image, is printed, only the developing unit 710 corresponding to the K color is used. In this case, only the intermediate transfer roller 732 corresponding to the K color is maintained at a pressing location where the intermediate transfer roller 732 is pressed toward the photoconductive drum 7*a* of the developing unit 710 corresponding to the intermediate transfer roller 732, and the other three intermediate transfer rollers 732 respectively corresponding to Y, C, and M colors may be positioned at releasing locations where pressing forces have been released. As such, pressing forces of intermediate transfer rollers 732 not used when a single-color image is printed are released, and thus wear of the intermediate transfer belt 731 may be reduced.

Figure 14:
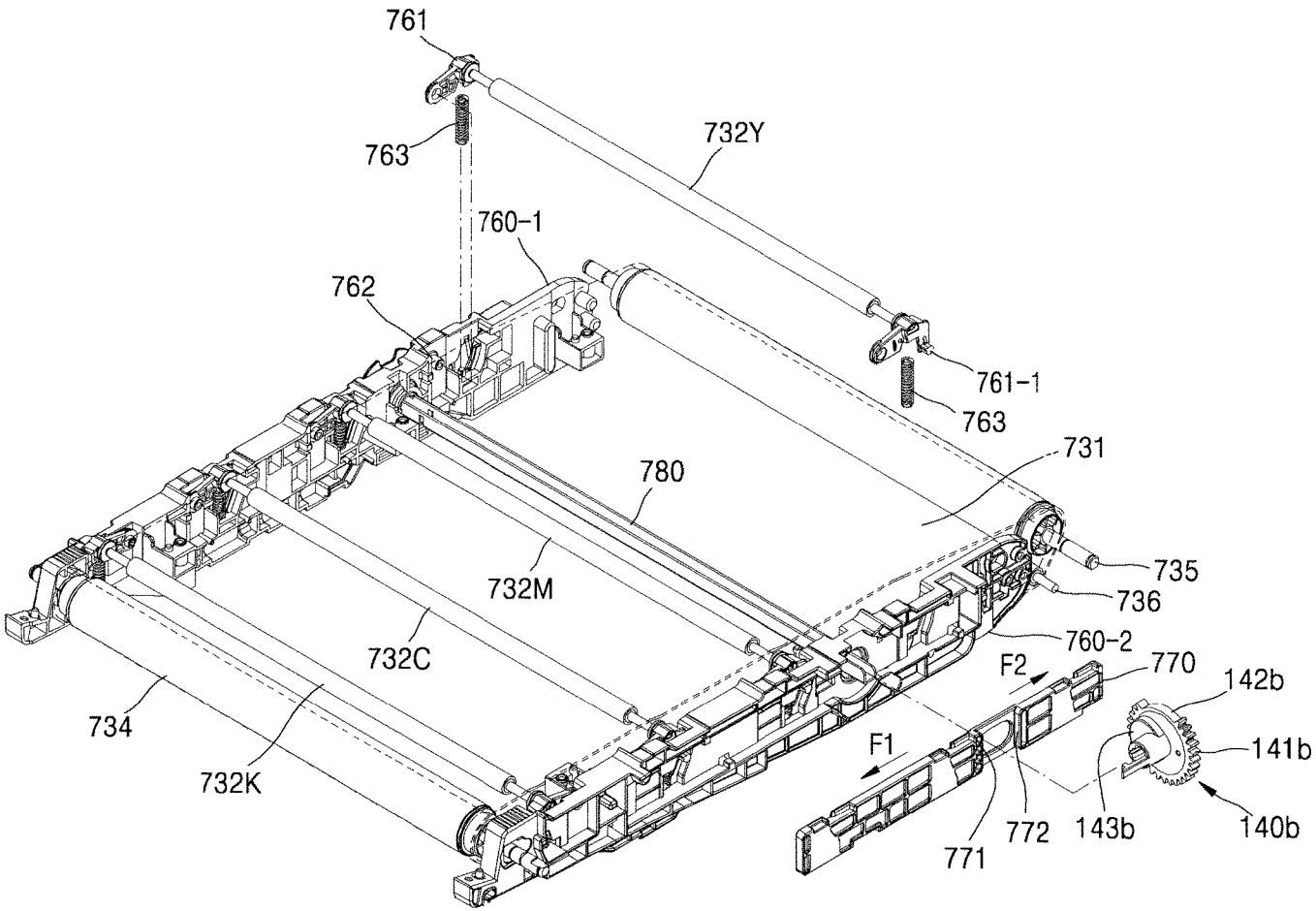
FIG. 14 is a partially-exploded perspective view of a transfer unit according to an embodiment.

FIG. 14 is a partially-exploded perspective view of a transfer unit according to an embodiment. Referring to FIG. 14, an intermediate transfer roller 732Y is supported by a pair of frames 760-1 and 760-2. For example, a pair of support brackets 761 are inserted into both ends of the intermediate transfer roller 732Y and are supported to be pivotable about shafts 762 provided on the frames 760-1 and 760-2. Springs 763 apply elastic forces so that the support brackets 761 are pivoted in a direction in which the intermediate transfer roller 732Y approaches a photoconductive drum 7*a*. Intermediate transfer rollers 732M and 732C are supported by the frames 760-1 and 760-2 according to the same method as that for the intermediate transfer roller 732Y. An intermediate transfer roller 732K may be supported by the frames 760-1 and 760-2 to be maintained at a pressing location. The intermediate transfer roller 732K may be supported by the frames 760-1 and 760-2 according to the same method as that for the intermediate transfer roller 732Y. However, the intermediate transfer roller 732K is maintained at the pressing location.

Figure 15:
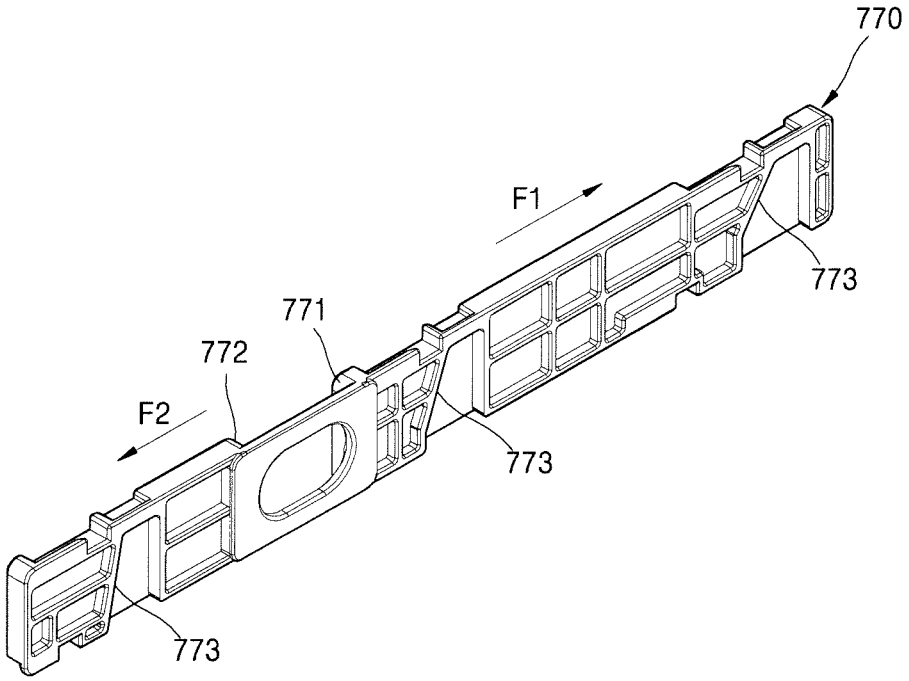
FIG. 15 is a perspective view of a releasing member according to an embodiment.

By pivoting the support brackets 761, the intermediate transfer rollers 732Y, 732M, and 732C may be switched between pressing locations and releasing locations. A releasing member 770 is slidably supported by each of the frames 760-1 and 760-2. For example, the releasing members 770 may be slidable in traveling directions F1 and F2 of the intermediate transfer belt 731. FIG. 15 is a perspective view of each releasing member 770 according to an embodiment. Referring to FIGS. 14 and 15, the releasing member 770 may include first and second contact portions 771 and 772 spaced apart from each other in the sliding direction. The releasing member 770 further may include three inclined portions 773 inclined in the sliding direction to pivot the support brackets 761. The inclined portions 773 interfere with an interfering portion 761-1 provided on each support bracket 761 and pivots the support bracket 761 in the sliding direction of the releasing member 770.

A rotation shaft 780 is rotatably supported by the frames 760-1 and 760-2. A cam gear 140*b* for sliding the releasing member 770 back and forth is coupled to the rotation shaft 780. The cam gear 140*b* may include a gear portion 141*b* and a cam portion 143*b*. A tooth-omitted portion 142*b* is partially provided on the gear portion 141*b*. When the cam portion 143*b* contacts the first contact portion 771, the releasing member 770 slides in the direction F1, in which the inclined portions 773 interfere with the interfering portion 761-1. Then, the support brackets 761 are pivoted in a direction opposite a direction of the elastic forces of the springs 763, and thus the intermediate transfer rollers 732Y, 732M, and 732C are moved to the releasing locations. When the cam portion 143*b* contacts the second contact portion 772, the releasing member 770 slides in the direction F2, in which the inclined portions 773 are spaced apart from the interfering portion 761-1. Then, due to the elastic forces of the springs 763, the support brackets 761 are pivoted in a direction for positioning the intermediate transfer rollers 732Y, 732M, and 732C at the pressing locations.

The swing arm 170, the first and second swing gears 181 and 182, and the cam gear 140 described above are employed to rotate the cam gear 140*b*, thereby reducing the costs for image forming apparatuses. FIGS. 16A-16D are side views illustrating a process of switching an intermediate transfer roller 732 between a pressing location and a releasing location.

Figure 16A:
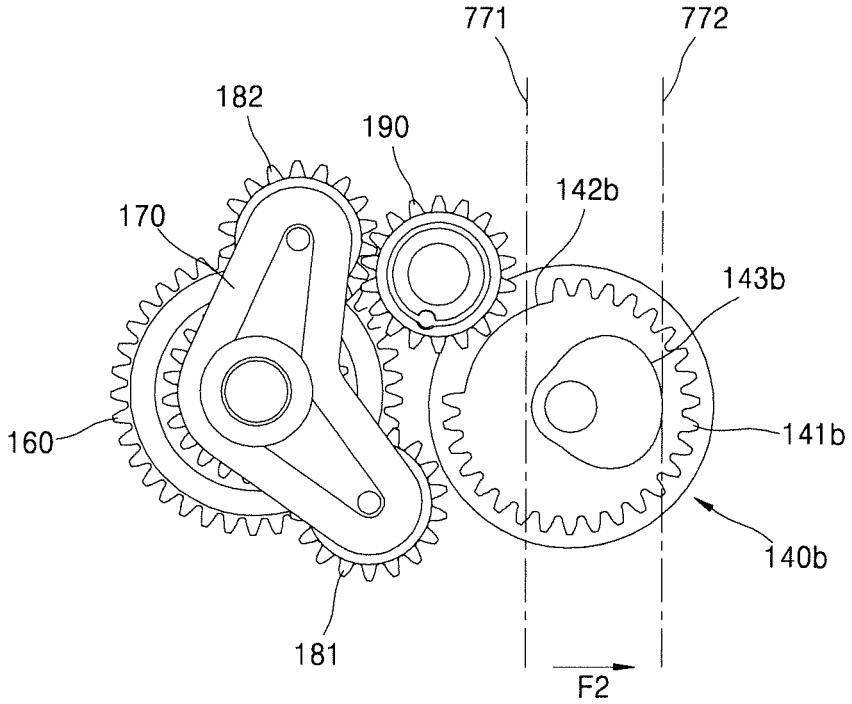
FIGS. 16A-16D are side views illustrating a process of switching an intermediate transfer roller between a pressing location and a releasing location.

Referring to FIG. 16A, the cam gear 140*b* is positioned at a first rotating location. The cam portion 143*b* contacts the second contact portion 772. The intermediate transfer rollers 732Y, 732M, and 732C are positioned at the pressing locations. The second swing gear 182 is connected to the idle gear 190, and the idle gear 190 is positioned on the tooth-omitted portion 142*b*. The first swing gear 181 is spaced apart from the gear portion 141*b*. Even when the main gear 160 rotates in a forward direction, the cam gear 140*b* is not rotated, and the intermediate transfer rollers 732Y, 732M, and 732C are maintained at the pressing locations. In this state, color printing may be performed.

Figure 16B:
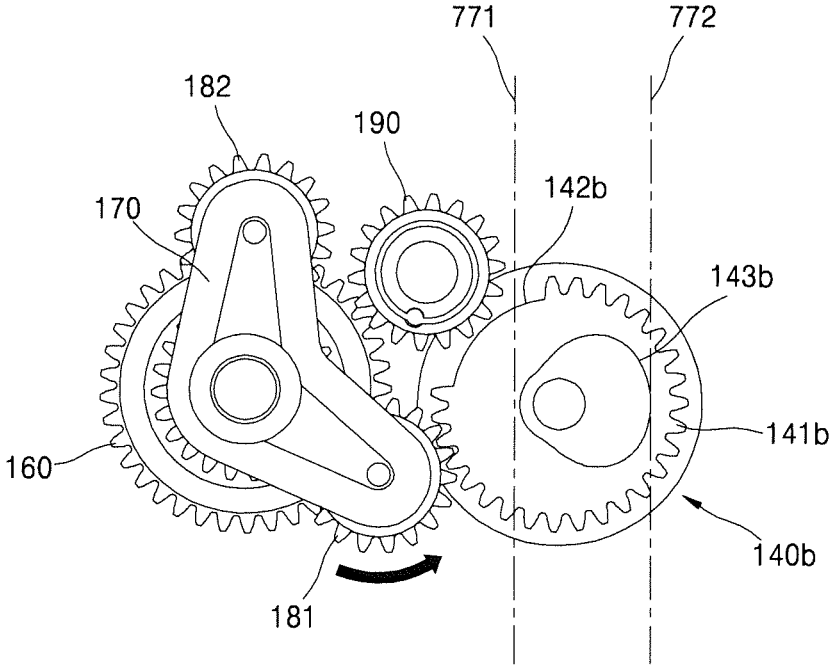

When a single-color image, namely, a K color image, desires to be printed, the main gear 160 is rotated in a backward direction. Then, as shown in FIG. 16B, the swing arm 170 rotates in the same direction as the rotating direction of the main gear 160, and the first swing gear 181 is connected to the gear portion 141*b*. The second swing gear 182 is spaced apart from the idle gear 190.

Figure 16C:
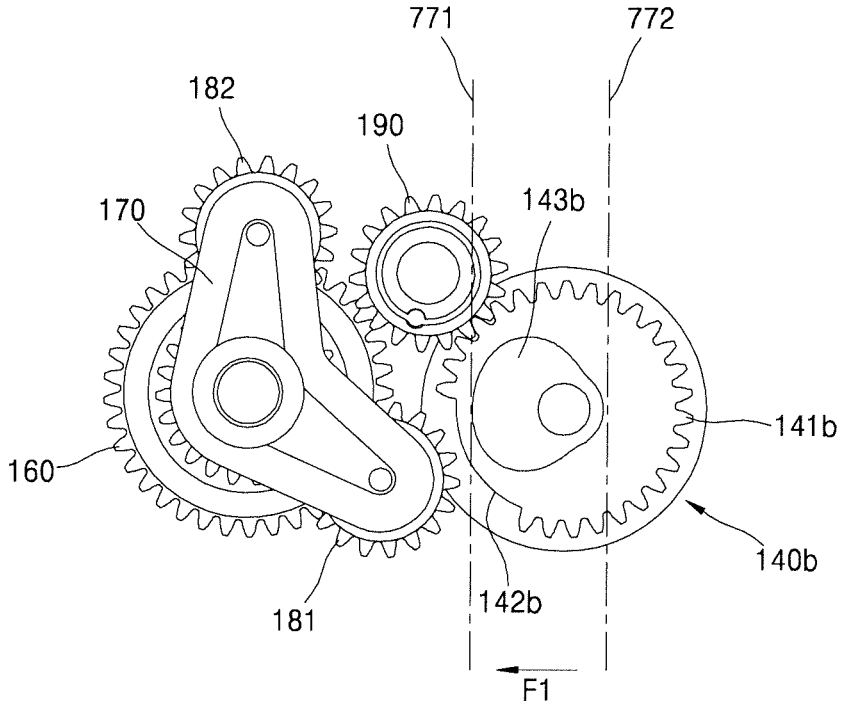

When the main gear 160 continuously rotates in the backward direction, the cam gear 140*b* is rotated, and thus the cam portion 143*b* contacts the first contact portion 771, as shown in FIG. 16C. Then, the releasing member 770 slides in the direction F1, and the inclined portions 773 press the interfering portion 761-1 and pivots the support bracket 761 in the direction opposite the direction of the elastic forces of the springs 763. Then, the intermediate transfer rollers 732Y, 732M, and 732C are moved to the releasing locations, and a transfer nip between the intermediate transfer rollers 732Y, 732M, and 732C and the photoconductive drums 7*a* corresponding to the intermediate transfer rollers 732Y, 732M, and 732C is released. At this time, when the cam gear 140*b* reaches a second rotating location, the first swing gear 181 is positioned on the tooth-omitted portion 142*b*, and the cam gear 140*b* reaches the second rotating location. In this state, a single-color image, namely, a K color image, may be printed.

To print a color image again, an operation of switching the intermediate transfer rollers 732Y, 732M, and 732C to the pressing locations is performed.

Figure 16D:
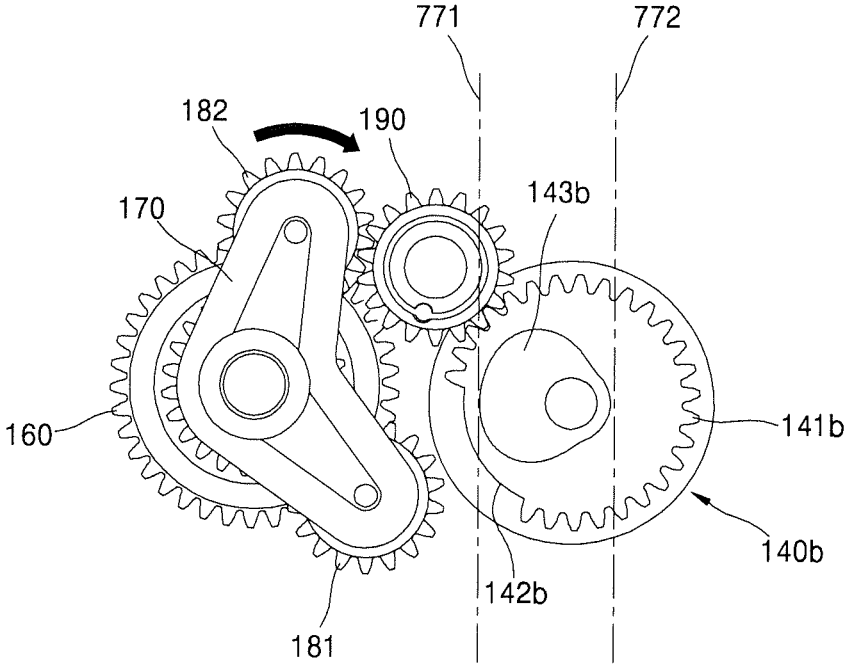

When the main gear 160 rotates in the forward direction, the second swing gear 182 is connected to the idle gear 190, as shown in FIG. 16D, and the first swing gear 181 is spaced apart from the tooth-omitted portion 141*b*. When the main gear 160 continuously rotates in the forward direction, the cam gear 140*b* returns to the first rotating location, as shown in FIG. 16A. When the cam portion 143*b* contacts the second contact portion 772, the releasing member 770 slides in the direction F2, in which the inclined portions 773 are spaced apart from the interfering portion 761-1. The support brackets 761 are pivoted in the direction of the elastic forces of the springs 763, and thus the intermediate transfer rollers 732Y, 732M, and 732C are moved to the pressing locations. The second swing gear 182 is connected to the idle gear 190, and the idle gear 190 is positioned on the tooth-omitted portion 142*b*. The first swing gear 181 is spaced apart from the gear portion 141*b*. Accordingly, even when the main gear 160 rotates in the forward direction, the cam gear 140*b* is not rotated, and the intermediate transfer rollers 732Y, 732M, and 732C are maintained at the pressing locations. In this state, color printing may be performed.

The main gear 160 may be rotated by a motor (not shown) for driving the intermediate transfer belt 731. The motor (not shown) may drive the other components of the image forming apparatus 700. According to the above-described structure, the intermediate transfer rollers 732Y, 732M, and 732C may be switched between pressing locations and releasing locations without employing a special driving source.

While one or more inventive concepts have been particularly shown and described with reference to exemplary embodiments thereof, it will be understood by those of ordinary skill in the art that various changes in form and details may be made therein without departing from the spirit and scope as defined by the following claims.

What is claimed is:

1. A sheet supplying apparatus, comprising:

a loading table to accommodate one or more sheets of a printing medium;

a pickup member to pick up a sheet from the loading table;

an alignment member pivotable to an alignment location for blocking and aligning a fore-end of a sheet on the loading table, and to a transport-allowing location for allowing a sheet picked up by the pickup member to be transported;

a pivoting shaft to which the alignment member is coupled;

a cam gear comprising a gear portion, a tooth-omitted portion, and a cam portion to switch the alignment member between the alignment location and the transport-allowing location at first and second rotating positions of the cam gear such that the alignment member pivots away from the cam gear when the alignment member is switched to the alignment location and pivots toward the cam gear when the alignment member is switched to the transport-allowing location;

a lever, coupled to the pivoting shaft, to selectively contact the cam portion, wherein:

when the cam gear is rotated to the first rotating position, the cam portion interacts with the lever to position the alignment member at the alignment location, and when the cam gear is rotated to the second rotating position, the cam portion is to be spaced apart from the lever to switch the alignment member to the transport-allowing location;

a main gear;

a swing arm pivotable about a same axis as a rotation axis of the main gear; and first and second swing gears supported by the swing arm to interlock with the main gear, to selectively interlock with the gear portion according to a rotating direction of the main gear, and to rotate the cam gear to the first and second rotating positions.

2. The sheet supplying apparatus of claim 1, wherein when the alignment member is positioned at the alignment location, the second swing gear contacts an idle gear positioned on the tooth-omitted portion, and when the alignment member is positioned at the transport-allowing location, the first swing gear is positioned on the tooth-omitted portion and the second swing gear is spaced apart from the idle gear.

3. The sheet supplying apparatus of claim 1, further comprising:

a holder to support the pickup member and be pivotable to a pickup location for allowing the pickup member to contact the sheet on the loading table, and a separating location for spacing the pickup member apart from the sheet on the loading table; and an elastic member to apply to the holder an elastic force in a direction allowing the holder to be pivoted to the pickup location, wherein the alignment member is to apply a force to the holder such that the holder is pivoted to the separating location, when the alignment member is switched from the transport-allowing location to the alignment location.

4. The sheet supplying apparatus of claim 3, wherein, when the alignment member is positioned at the alignment location, the alignment member supports the holder such that the holder is maintained at the separating location.

5. The sheet supplying apparatus of claim 4, wherein, when the alignment member is switched from the alignment location to the transport-allowing location, the holder is pivoted to the pickup location by the elastic force of the elastic member.

6. The sheet supplying apparatus of claim 1, further comprising an idle gear interposed between one of the first and second swing gears and the gear portion.

7. The sheet supplying apparatus of claim 1, further comprising an elastic member to apply to the pivoting shaft an elastic force in a direction allowing the alignment member to be switched to the transport-allowing location.

8. The sheet supplying apparatus of claim 1, further comprising a stopper to stop the alignment member so that the alignment member is not excessively pivoted beyond the transport-allowing location.

9. A sheet processing apparatus, comprising:

the sheet supplying apparatus of claim 1; and a sheet processing unit to perform processing on a sheet supplied by the sheet supplying apparatus.

10. The sheet processing apparatus of claim 9, wherein the sheet processing unit comprises a read unit to read an image from the sheet.

11. The sheet processing apparatus of claim 9, wherein the sheet processing unit comprises a printing unit to print an image on the sheet.

* * * * *